US012642353B2

(12) United States Patent
Wright et al.

(10) Patent No.: US 12,642,353 B2
(45) Date of Patent: Jun. 2, 2026

(54) MODULAR MILLWORK METHOD AND APPARATUS

(71) Applicant: Capsule Manufacturing Inc., Anaheim, CA (US)

(72) Inventors: Wade Jarman Wright, Costa Mesa, CA (US); Chad Michael Bowker, Orange, CA (US)

( * ) Notice: Subject to any disclaimer, the term of this patent is extended or adjusted under 35 U.S.C. 154(b) by 351 days.

(21) Appl. No.: 18/352,917

(22) Filed: Jul. 14, 2023

(65) Prior Publication Data

US 2024/0016289 A1 Jan. 18, 2024

Related U.S. Application Data

(60) Provisional application No. 63/389,642, filed on Jul. 15, 2022.

(51) Int. Cl.

| | |
|---|---|
| ***A47B 77/06*** | (2006.01) |
| ***A47B 47/05*** | (2006.01) |
| ***A47B 91/02*** | (2006.01) |
| ***A47B 95/00*** | (2006.01) |
| ***A47B 96/20*** | (2006.01) |

(52) U.S. Cl.

CPC ..... *A47B 77/06* (2013.01); *A47B 47/05* (2013.01); *A47B 95/008* (2013.01); *A47B 91/024* (2013.01); *A47B 2096/209* (2013.01)

(58) Field of Classification Search

CPC ..... A47B 47/047; A47B 47/05; A47B 77/00; A47B 77/02; A47B 77/06; A47B 2077/027; A47B 95/008; A47B 2096/209; A47B 91/024

See application file for complete search history.

(56) References Cited

U.S. PATENT DOCUMENTS

| | | | | |
|---|---|---|---|---|
| 2,007,184 | A * | 7/1935 | Dunning | A47B 77/08 312/278 |
| 5,309,686 | A * | 5/1994 | Underwood | A47B 96/04 52/36.5 |
| 8,333,038 | B2 * | 12/2012 | Bates | A47B 96/067 52/36.5 |
| 9,125,492 | B1 * | 9/2015 | Kane | A47B 96/00 |
| 9,185,980 | B1 * | 11/2015 | Kane | A47B 88/944 |
| 9,185,981 | B1 * | 11/2015 | Kane | A47B 96/00 |
| 10,072,873 | B1 * | 9/2018 | Ostera | F24H 9/06 |
| 10,271,652 | B2 * | 4/2019 | Kilburn | E05D 15/0604 |

(Continued)

FOREIGN PATENT DOCUMENTS

| | | | | |
|---|---|---|---|---|
| CN | 214341054 U | * | 10/2021 | |
| CN | 114365911 A | * | 4/2022 | E04F 13/0733 |

(Continued)

*Primary Examiner* — Andrew Roersma

(74) *Attorney, Agent, or Firm* — Ferguson Braswell Fraser Kubasta PC

(57) ABSTRACT

Systems, apparatus, and methods form cabinetry for installations utilizing metallic chassis. The chassis is metallic and forms a load bearing structure of a cabinet. A chassis member, of multiple chassis members forming the chassis, is assembled to the chassis using one or more fasteners of the cabinet. Multiple finishing members include an interior member assembled to an interior of the chassis and an exterior member assembled to an exterior of the chassis. A securing member is used to affix the cabinet to a mounting rail.

20 Claims, 39 Drawing Sheets

(56) References Cited

U.S. PATENT DOCUMENTS

| | | | | |
|---|---|---|---|---|
| 10,856,658 | B2 * | 12/2020 | Berloni | A47B 77/02 |
| 2010/0090567 | A1 * | 4/2010 | Felice | A47B 47/0091 312/107 |
| 2011/0011855 | A1 * | 1/2011 | Han | A47B 47/05 220/4.33 |
| 2011/0025180 | A1 * | 2/2011 | Ilich | A47B 95/008 29/428 |
| 2013/0180202 | A1 * | 7/2013 | Woods | A47B 95/008 52/710 |
| 2013/0264924 | A1 * | 10/2013 | Tusk | A47B 47/0041 312/265.5 |
| 2014/0054252 | A1 * | 2/2014 | Woodley | A47B 13/083 211/183 |
| 2018/0094431 | A1 * | 4/2018 | Koziol | E04F 13/081 |
| 2019/0003637 | A1 * | 1/2019 | Ostera | A47G 1/1613 |
| 2019/0200755 | A1 * | 7/2019 | Moretti | A47B 77/02 |
| 2020/0332529 | A1 * | 10/2020 | Stanford | A47B 77/02 |
| 2021/0106135 | A1 * | 4/2021 | Gullo | A47B 47/02 |

FOREIGN PATENT DOCUMENTS

| | | | | |
|---|---|---|---|---|
| DE | 202009000241 | U1 * | 5/2010 | A47B 95/008 |
| DE | 20201103742 | U1 * | 8/2021 | A47B 95/008 |
| WO | WO-2014033358 | A1 * | 3/2014 | A47B 47/05 |
| WO | WO-2023237907 | A1 * | 12/2023 | A47B 95/008 |

* cited by examiner

MOUNTING RAIL 900
FLANGE 905
U-CHANNEL 902

FLANGE 905
UPPER SCREW HOLES 922
ALIGNMENT HOLES 927
LOWER SCREW HOLES 925
MOUNTING RAIL 900

SLOTS 950
MOUNTING RAIL 900

MODULAR MILLWORK METHOD AND APPARATUS

CROSS-REFERENCE TO RELATED APPLICATIONS

This application claims priority from U.S. Provisional Application 63/389,642, filed Jul. 15, 2022, which is herein incorporated by reference.

BACKGROUND

Millwork items, including cabinetry and backsplashes, created with woodwork may not include the benefits of strength and durability of using metal instead of wood. A challenge to achieving the benefits of using metal includes reducing the time and labor to create and install the mill work items.

SUMMARY

Systems, apparatus, and methods form cabinetry for installations utilizing metallic chassis. The chassis is metallic and forms a load bearing structure of a cabinet. A chassis member, of multiple chassis members forming the chassis, is assembled to the chassis using one or more fasteners of the cabinet. Multiple finishing members include an interior member assembled to an interior of the chassis and an exterior member assembled to an exterior of the chassis. A securing member is used to affix the cabinet to a mounting rail.

Other aspects of the one or more embodiments will be apparent from the following description and the appended claims.

BRIEF DESCRIPTION OF DRAWINGS

Like elements in the various figures are denoted by like reference numerals for consistency.

DETAILED DESCRIPTION

In general, the one or more embodiments are directed to improving installations of millwork items. The millwork items may be improved with durability and by reducing the time to install the millwork.

Figure 1:
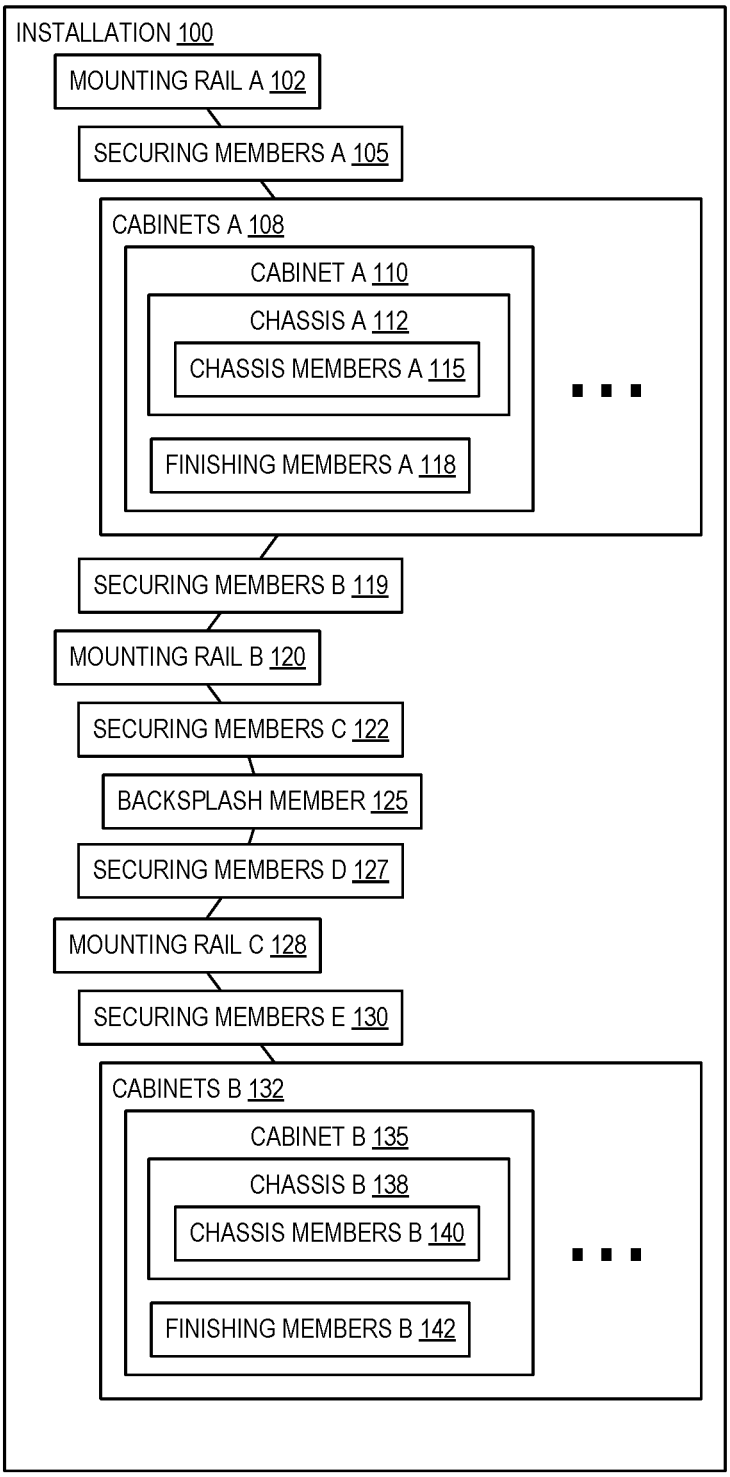
FIG. 1 shows a system, in accordance with one or more embodiments of the disclosure.

Turning to FIG. 1, the installation (100) is an installation of millwork. The installation (100) may include cabinets, backsplashes, sinks, countertops, etc. In one embodiment, the installation (100) includes the cabinets A (108) and B (132), which are secured to the mounting rails A (102), B (120), and C (128) with the securing members A (105), B (119), C (122), D (127), and E (130).

The mounting rails A (102), B (120), and C (128) are rails used to mount the cabinets A (108) and B (132) and the backsplash member (125) as part of the installation (100). In one embodiment, the mounting rails A (102), B (120), and C (128) are steel rails that are installed by screwing the mounting rails A (102), B (120), and C (128) to one or more studs of a wall.

The securing members A (105), B (119), C (122), D (127), and E (130) secure the cabinets A (108) and B (132) and the backsplash member (125) to the mounting rails A (102), B (120), and C (128). The securing members A (105), B (119), C (122), D (127), and E (130) may include fasteners (e.g., screws), shims, tabs, interlocking components of the cabinets A (108) and B (132), the backsplash member (125), and the mounting rails A (102), B (120), and C (128), etc. For example, the securing members B (119) may include a z-bar of the cabinet A (110) that interlocks with a flange of the mounting rail B (120) as well as additional fasteners that secure the cabinet A (110) to the mounting rail B (120).

The cabinets A (108) and B (132) are sets of cabinetry that may each include one or more cabinets. The cabinets A (108) may be upper cabinets mounted above the cabinets B (132), which may be lower cabinets. The cabinets A (108) includes the cabinet A (110) and the cabinets B (132) include the cabinet B (135).

The cabinet A (110) is an upper cabinet installed above the backsplash member (125) and secured to the mounting rails A (102) and B (120). The cabinet A (110) includes the chassis A (112) and the finishing members A (118).

The chassis A (112) forms a load bearing structure of the cabinet A (110). The chassis A (112) is assembled from the chassis members A (115). In one embodiment, the chassis A (112) (and the chassis B (138)) may be made of galvanized steel.

The chassis members A (115) are members of the chassis A (112). In one embodiment, the chassis members A (115) are made from metal and include features (tabs, holes, cuts, etc.) to which the finishing members A (118) are attached.

The finishing members A (118) and B (142) are the finished surfaces for the cabinets A (110) and B (135). The finishing members A (118) are affixed to the chassis members A (115) of the chassis A (112). The finishing members A (118) and B (142) may include a wood finish, a metal finish, a painted finish, a stone finish, a tile finish, etc. The finishing members A (118) of the upper cabinet A (110) may include panels, shelves, doors, drawers, trim, etc.

The finishing members A (118) and B (142) may include embedded magnets used to affix the finishing members A (118) and B (142) to the chassis A ((112) and B (138). The use of magnets (which may be embedded within the finishing members A (118) and B (142)) to secure the finishing members A (118) and B (142) to the chassis A (112) and B (138) is facilitated by the chassis A (112) and B (138) being made of ferromagnetic material, e.g., steel.

The backsplash member (125) is a finished surface installed between the cabinets A (108) and the cabinets B (132). The backsplash member (125) is secured to the mounting rail B (120) and the mounting rail C (128) by the securing members C (122) and the securing members D (127). The backsplash member (125) may include a wood finish, a metal finish, a painted finish, a stone finish, a tile finish, etc.

The cabinet B (135) is a lower cabinet installed below the backsplash member (125) and secured to the mounting rail C (128) The cabinet B (135) includes the chassis B (138)

with the chassis members B (140) and includes the finishing members B (142), which may be similar to corresponding elements of the cabinets A (108). The finishing members B (142) of the lower cabinet B (135) may also include countertops, sinks, etc.

Figure 2:
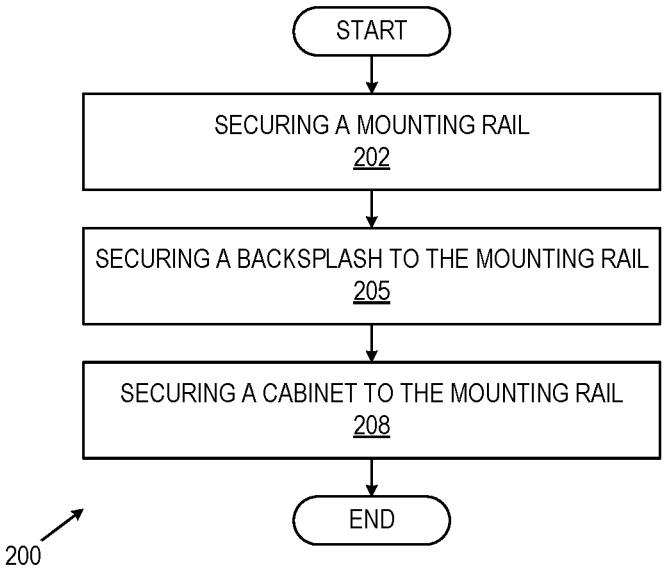
FIG. 2 shows a method in accordance with one or more embodiments of the disclosure.

Turning to FIG. 2, the method (200) installs millwork in accordance with one or more embodiments. The method (200) may be performed using the components described of FIG. 1.

Step 202 of the process (200) includes securing a mounting rail. In one embodiment, the mounting rail is secured to a stud of a wall with multiple screws extended through the mounting rail into the stud. In one embodiment, the mounting rail is one of multiple mounting rails that are installed. In one embodiment, alignment between multiple mounting rails is provided by one or more spacer sticks that are placed into the mounting rails, and then removed to install the cabinetry of the installation.

Step 205 of the process (200) includes securing a backsplash to the mounting rail. In one embodiment, the backsplash may be secured to the mounting rail with one or more tabs inserted into slots of the mounting rail. Each of the tabs may include a hole, which may be threaded or include a mounting member (e.g., a rivnut), through which a screw may be inserted to provide tension between the mounting rail, the tab, and the backsplash to secure the backsplash to an installation.

Step 208 of the process (200) includes securing a cabinet to the mounting rail. In one embodiment, a z-bar of the cabinet interconnects with a flange of the mounting rail. One or more screws may be inserted through the cabinet to the mounting rail to provide tension for securing the cabinet to the mounting rail.

FIGS. 3 through 8C illustrate an embodiment of an installation and corresponding components in accordance with the disclosure. FIGS. 9A through 17E illustrate an additional embodiment of an installation and corresponding components in accordance with the disclosure. Features illustrated in different figures or embodiments may combined.

Figure 3:
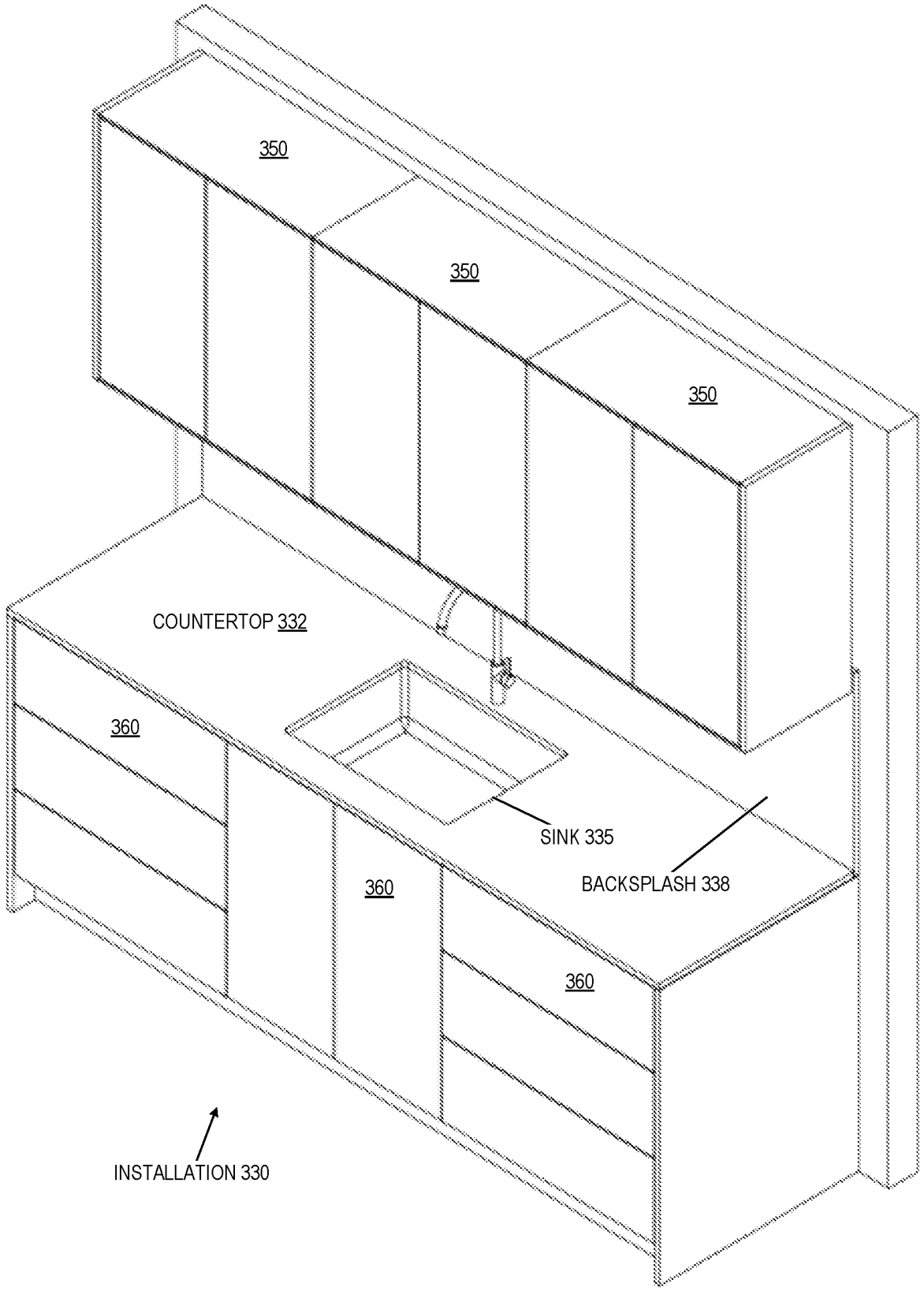
FIG. 3, FIG. 4, FIG. 5A, FIG. 5B, FIG. 6, FIG. 7A, FIG. 7B, FIG. 7C, FIG. 7D, FIG. 7E, FIG. 7F, FIG. 8A, FIG. 8B, FIG. 8C, FIG. 9A, FIG. 9B, FIG. 9C, FIG. 9D, FIG. 9E, FIG. 9F, FIG. 10A, FIG. 10B, FIG. 10C, FIG. 10D, FIG. 10E, FIG. 10F, FIG. 10G, FIG. 11A, FIG. 11B, FIG. 11C, FIG. 11D, FIG. 11E, FIG. 11F, FIG. 11G, FIG. 12A, FIG. 12B, FIG. 12C, FIG. 12D, FIG. 12E, FIG. 13A, FIG. 13B, FIG. 13C, FIG. 13D, FIG. 13E, FIG. 13F, FIG. 13G, FIG. 13H, FIG. 14, FIG. 15, FIG. 16A, FIG. 16B, FIG. 16C, FIG. 17A, FIG. 17B, FIG. 17C, FIG. 17D, and FIG. 17E show examples in accordance with one or more embodiments of the disclosure.

Turning to FIG. 3, the installation (330) forms a kitchen shelving system. The installation (330) includes finishing members that include the countertop (332), the sink (335), and the backsplash (338). The installation (330) includes the upper cabinets (350) and the lower cabinets (360).

Figure 4:
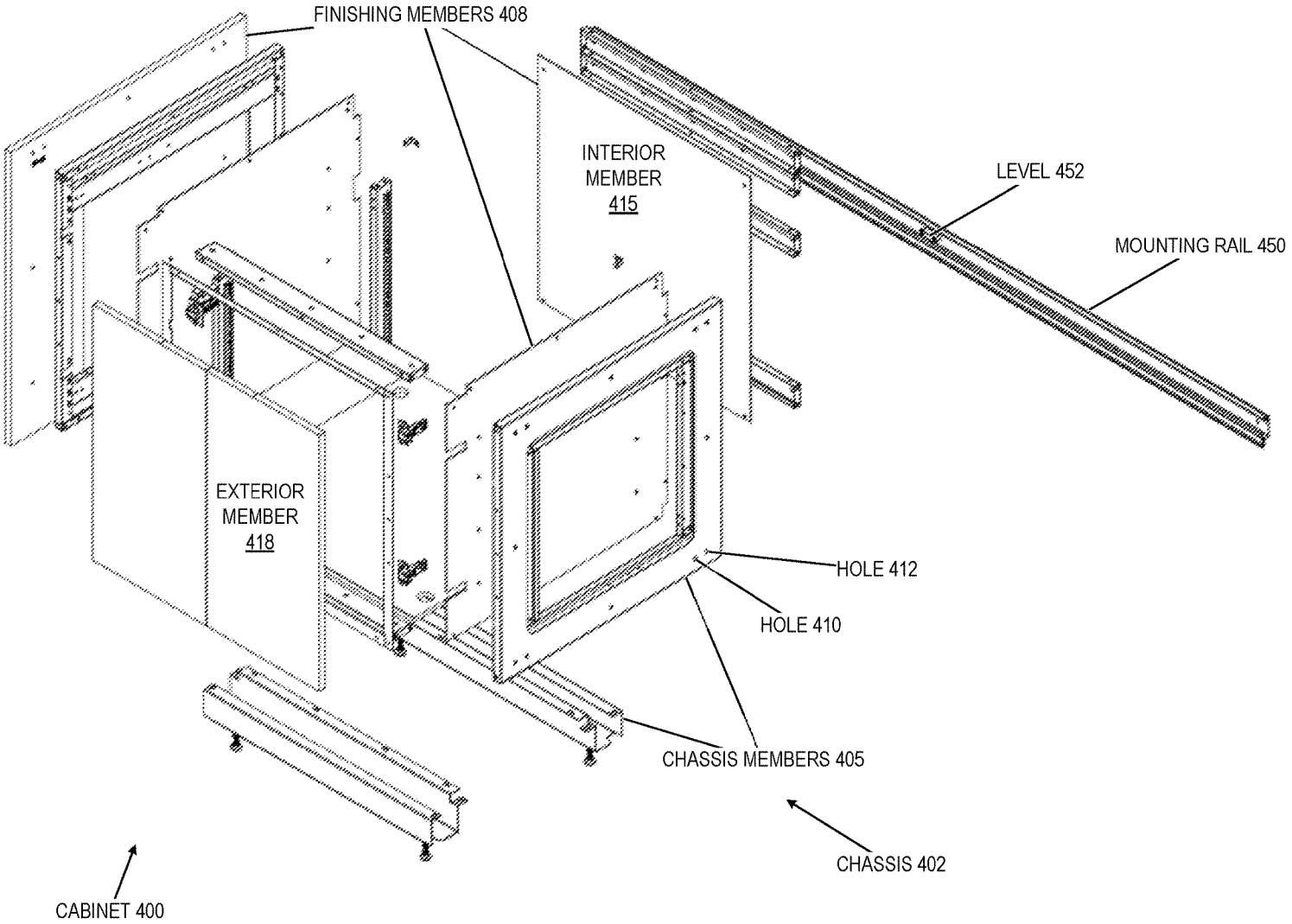

Turning to FIG. 4, an exploded view of the cabinet (400) of an installation is shown. The cabinet (400) includes the chassis (402), the chassis members (405), and the finishing members (408). The chassis (402) is metallic and forms a load bearing structure of the cabinet (400).

The chassis members (405) form the chassis (402). The chassis members (405) are assembled to form the chassis using one or more fasteners and a fastener pattern. For example, the hole (410) is for a first fastener pattern and the hole (412) is for a second fastener pattern. Different fastener patterns may be used to affix different members and panels to the chassis (402).

The finishing members (408) include the interior member (415) assembled to an interior of the chassis. The finishing members (408) also include the exterior member (418) assembled to an exterior of the chassis (402).

The cabinet (400) may be secured to the mounting rail (450). The mounting rail (450) includes the level (452), which may be used install the mounting rail (450) parallel to a floor.

Figure 5A:
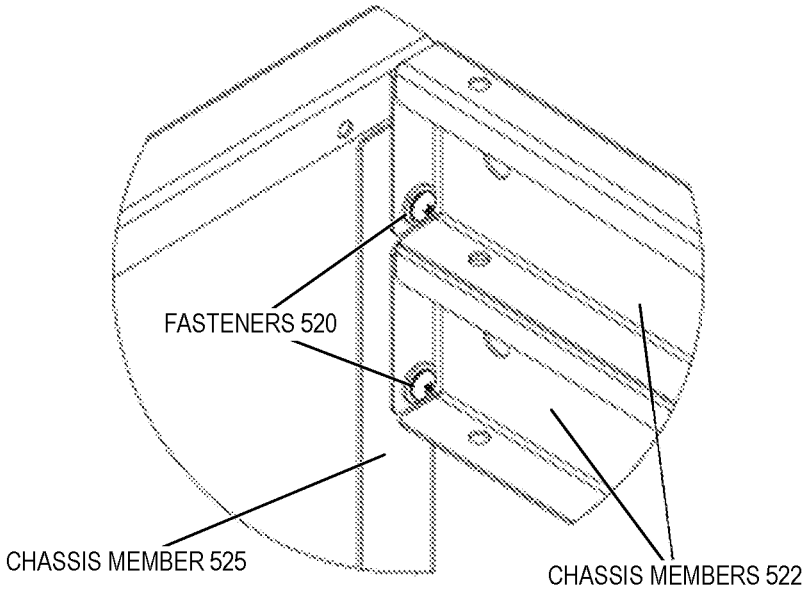
Figure 5B:
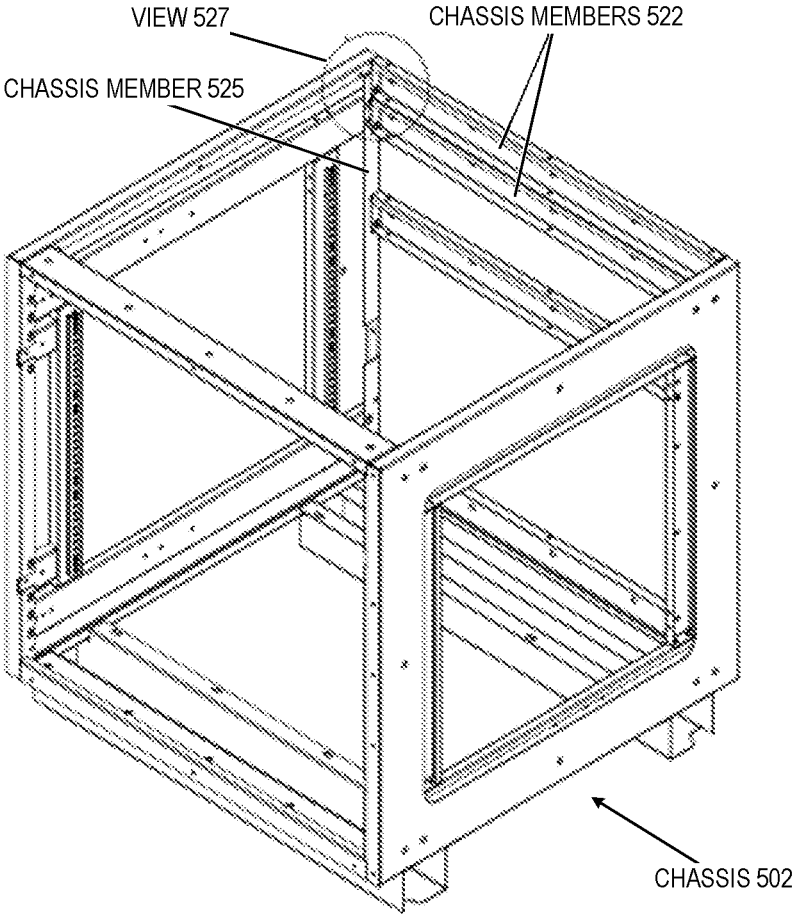

Turning to FIG. 5A illustrates the view (527) of FIG. 5B. The chassis member (525) is secured to the chassis members (522) with the fasteners (520).

Turning to FIG. 5B, the chassis (502) is assembled using the fasteners (520). In one embodiment, a magnetic fastener may be used. Using fasteners that fasten to the chassis (502), which is metallic, is an improvement over fasteners that, for example, screw into wooden members and may only be used a few times before stripping out the holes for the screws. The view (527) is illustrated by FIG. 5A.

Figure 6:
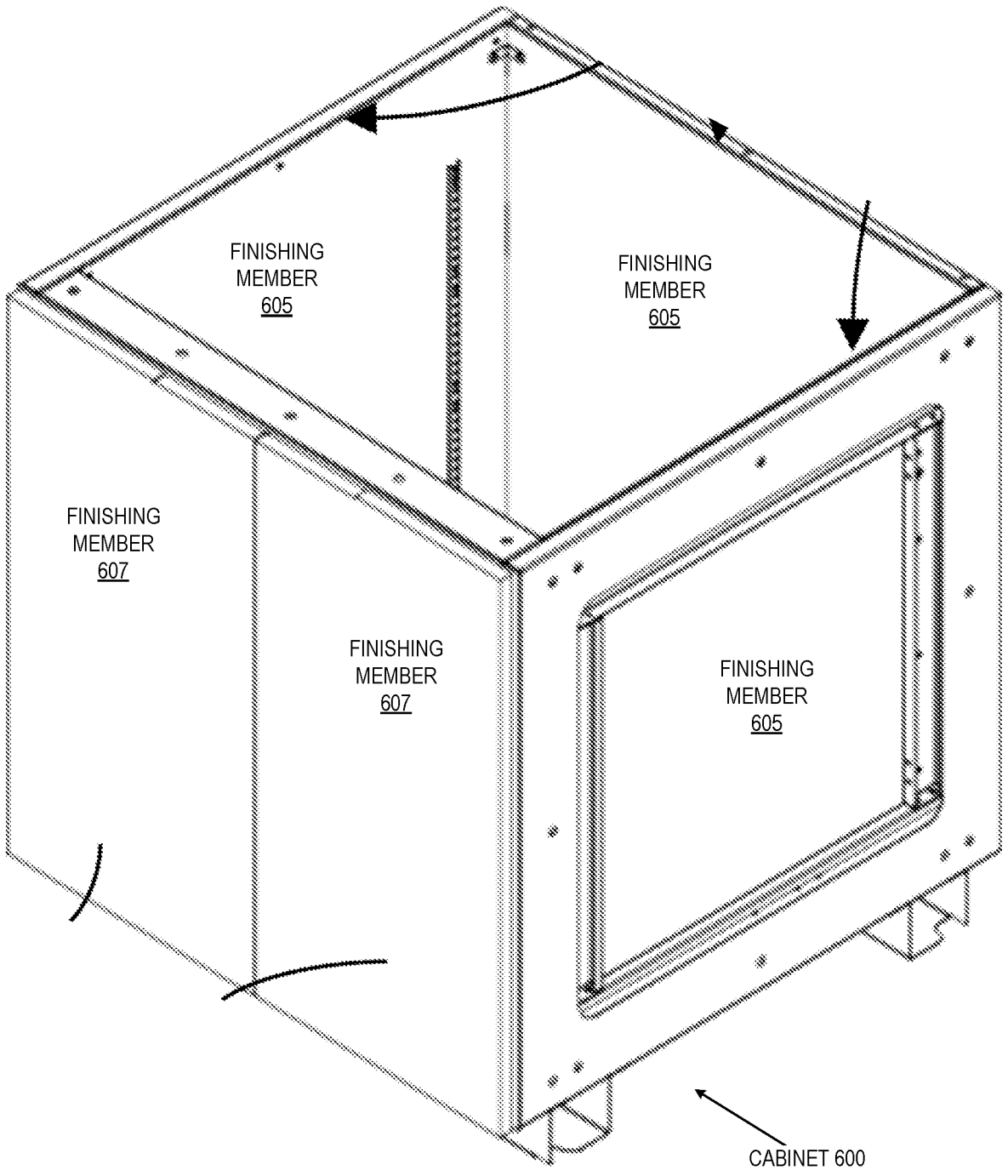

Turning to FIG. 6, the cabinet (600) is assembled from the chassis (602) and the finishing members (605) and (607). The finishing members (605) form the interior surfaces of the cabinet (600). The finishing members (607) form the front exterior doors of the cabinet (600) through which access is provided to the interior of the cabinet (600).

Figure 7A:
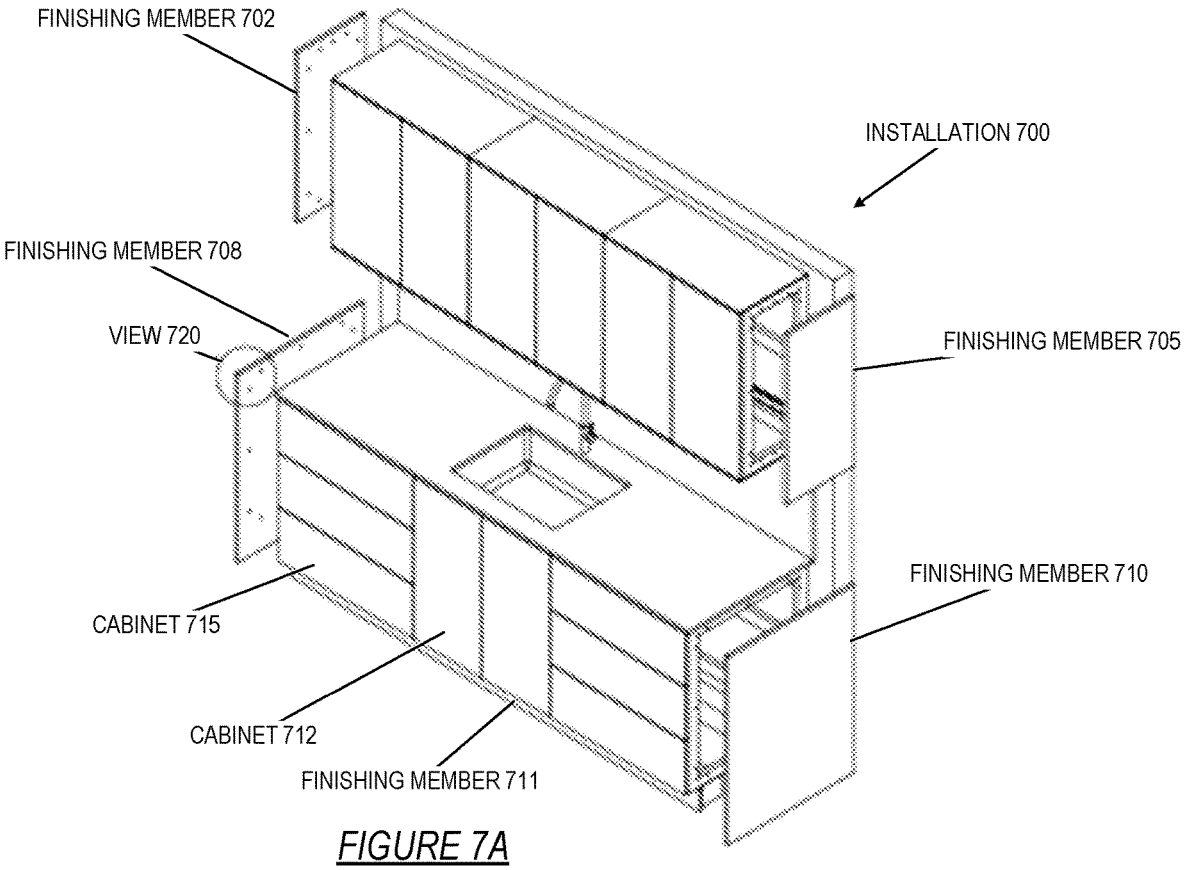

Turning to FIG. 7A, the installation (700) is illustrated in an exploded view. The upper cabinets include the finishing members (702) and (705). The lower cabinets include the cabinets (712) and (715) and the finishing members (708) and (710). The view (720) is illustrated by FIG. 7B.

The cabinet (712) includes doors, and the cabinet (715) includes drawers. In one embodiment, the cabinets (712) and (715) may each include a similar chassis onto which different finishing members are installed.

The installation (700) includes the finishing member (711). The finishing member (711) is a magnetic cove base that may be a kick plate of the installation (700). The finishing member (711) may include magnets to secure the finishing member (711) to the chassis of one or more of the lower cabinets of the installation (700). For example, each of the cabinets (712) and (715) may have a separate magnetic cove base. In one embodiment, a single magnetic cove base may be used to cover both of the cabinets (712) and (715).

Figure 7B:
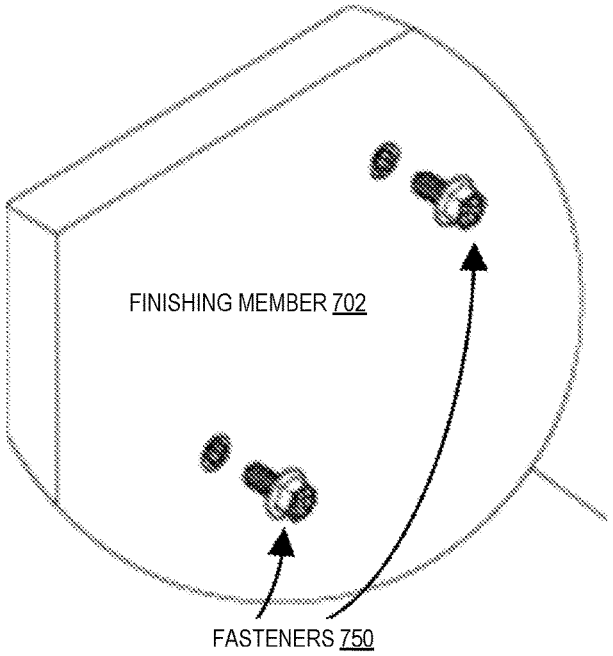

Turning to FIG. 7B, the finishing member (702) may be fastened to the upper cabinets of the installation (700) of FIG. 7A. The finishing member (702) includes features (e.g., threaded holes) for the fasteners (750). The features of the finishing member (702) are on an interior surface of the finishing member (702) to keep a smooth exterior finish on the finishing member (702).

Figure 7C:
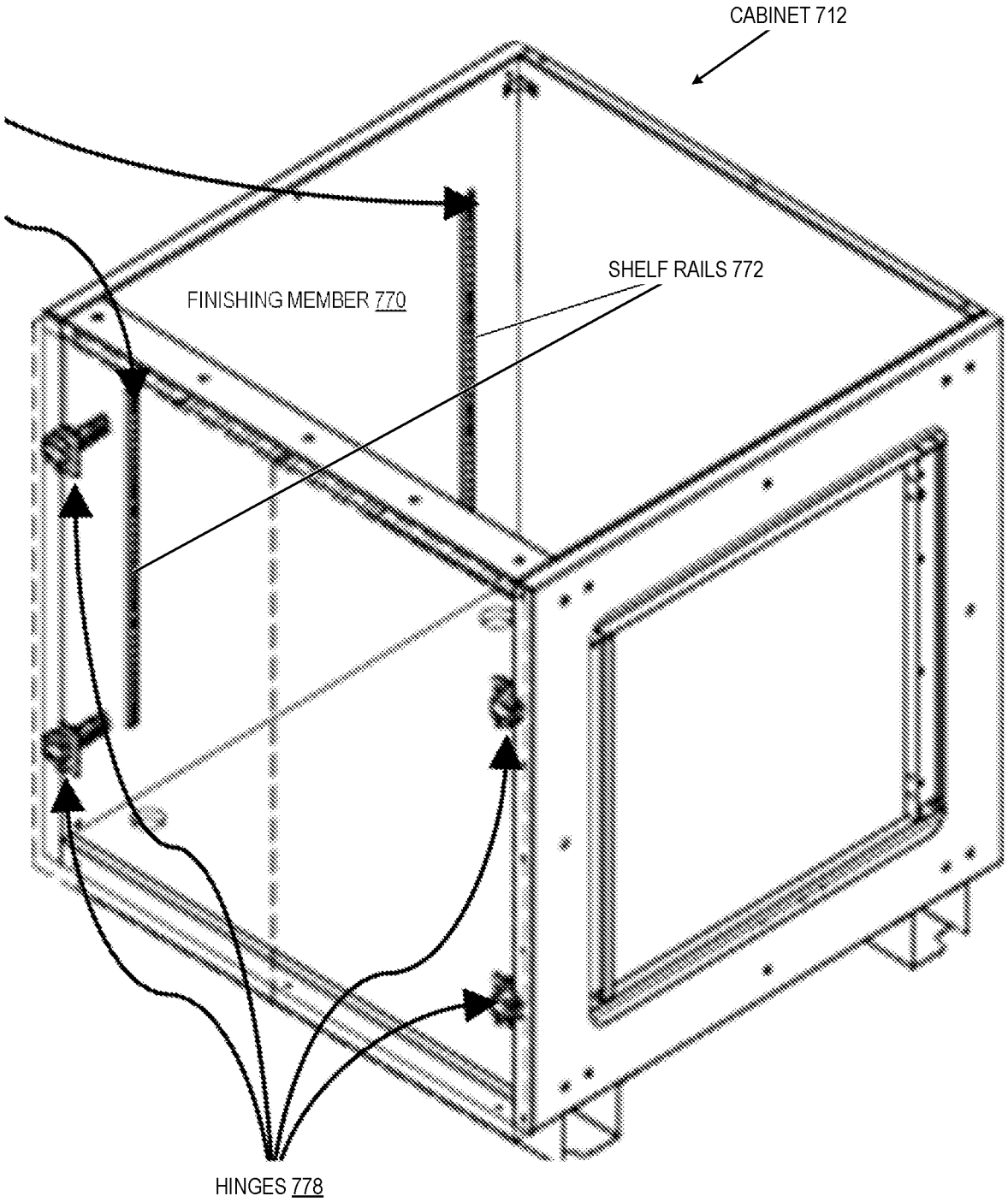

Turning to FIG. 7C, the cabinet (712) of FIG. 7A is illustrated. The cabinet (712) includes the finishing member (770), which forms an interior surface of the cabinet (712). The finishing member (770) includes the shelf rails (772) to which one or more shelves may be mounted. The cabinet (712) includes the hinges (778) for doors to be mounted to the front of the cabinet.

Figure 7D:
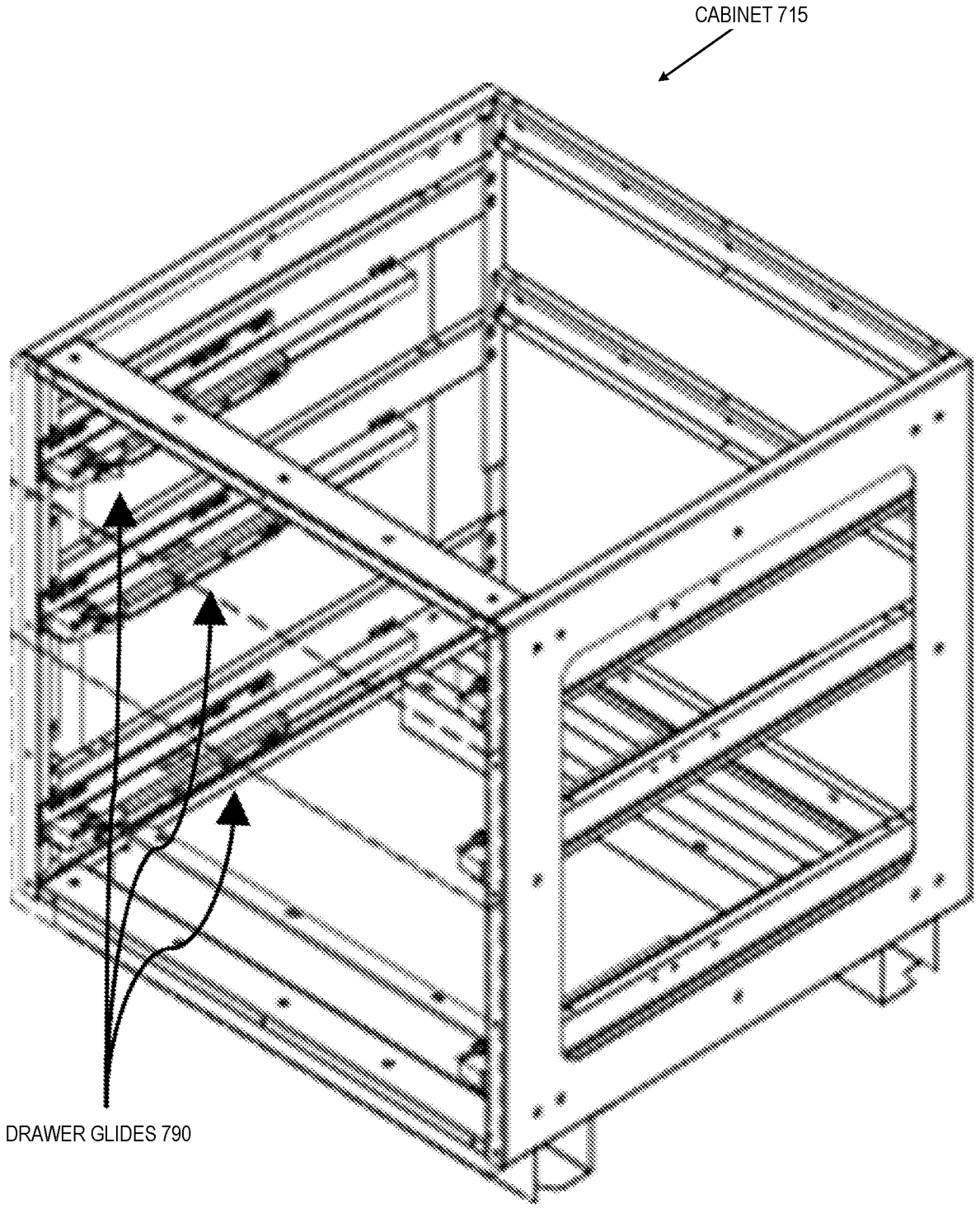

Turning to FIG. 7D, the cabinet (715) includes the drawer glides (790). The drawer glides (790) are used to install drawers to the cabinet (715).

Figure 7E:
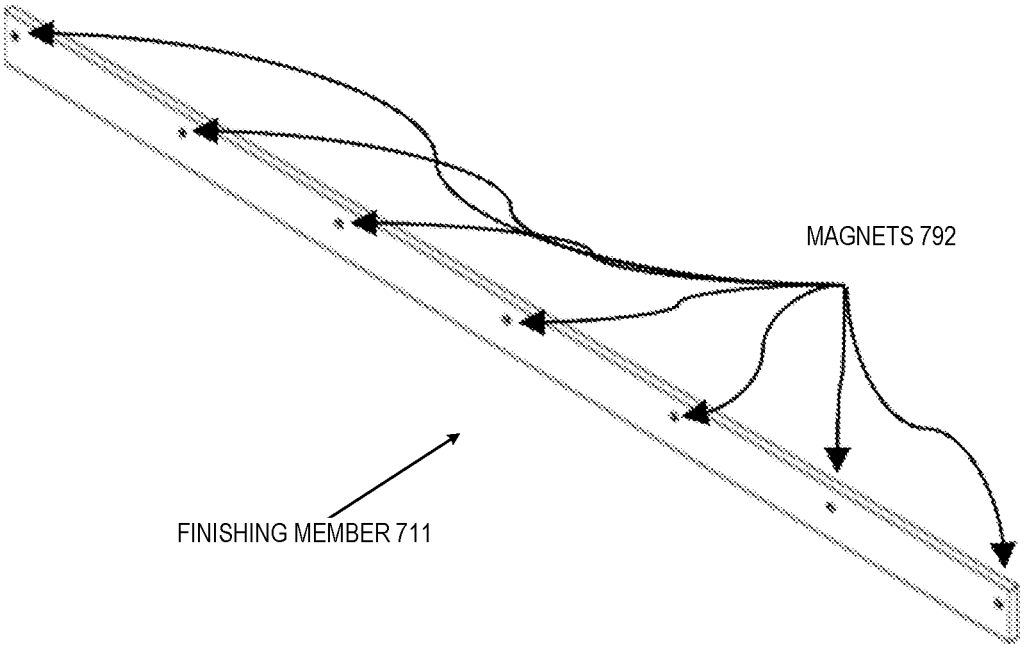

Turning to FIG. 7E, the finishing member (711) is a magnetic cove base that includes the magnets (792). The magnets (792) secure the finishing member (711) to the chassis of one or more of the lower cabinets of the installation (700) of FIG. 7A.

Figure 7F:
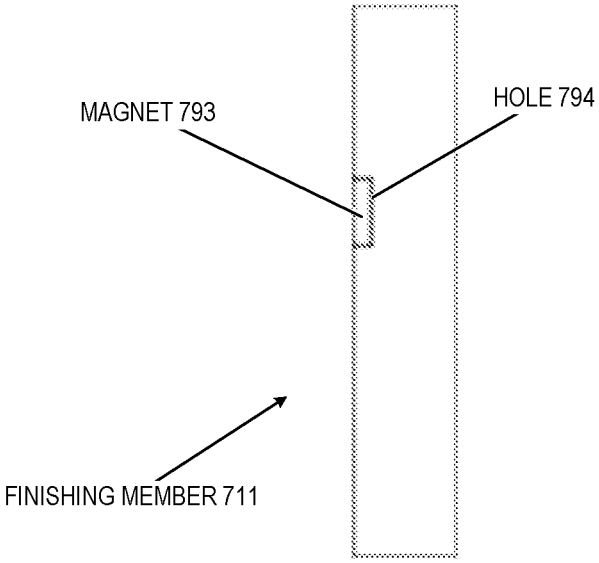

Turning to FIG. 7F, the finishing member (711) includes the magnet (793), which is one of the magnets (792) of FIG. 7E. In one embodiment, the magnet (793) is secured into the hole (794) using an adhesive, a fastener, etc.

Figure 8A:
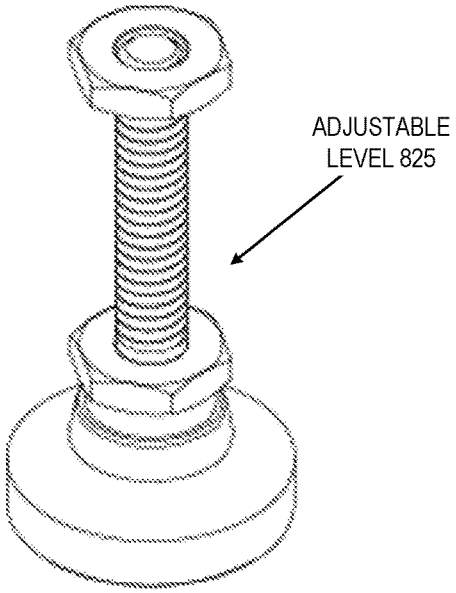
Figure 8B:
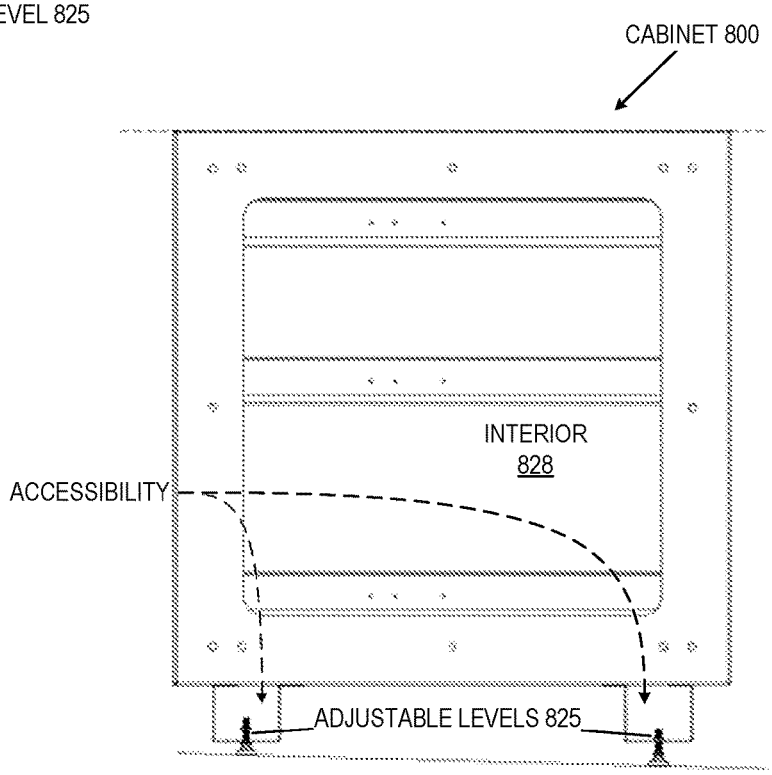

Turning to FIG. 8A, the adjustable level (825) may be used with the cabinet (800) of FIG. 8B. The adjustable level (825) may be installed to a bottom portion of the cabinet (800) of FIG. 8B.

Turning to FIG. 8B, a side view of the cabinet (800) is shown. The adjustable levels (825) are affixed to the cabinet (800). The adjustable levels (825) are positioned to be accessible through the interior (828) of the chassis (802).

Figure 8C:
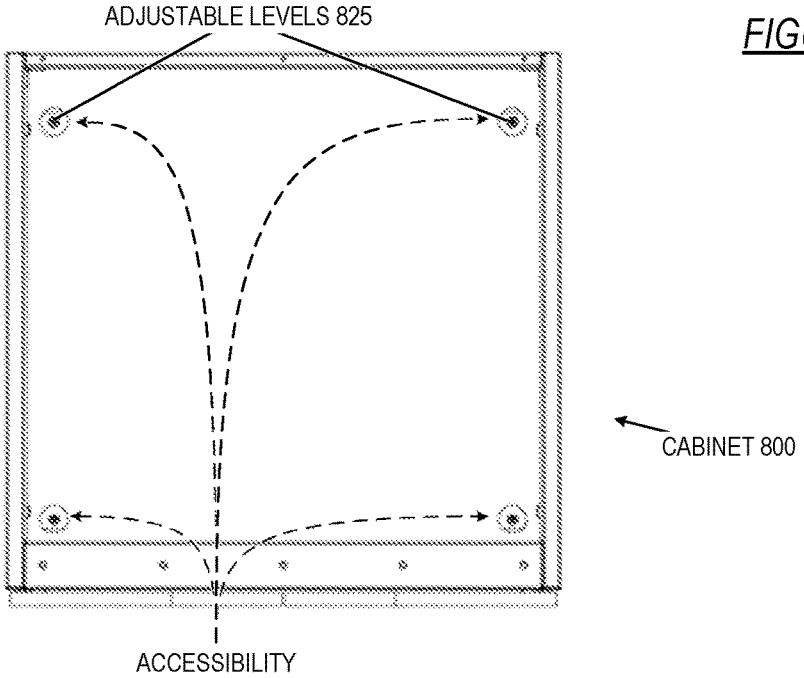

Turning to FIG. 8C, a bottom view of the cabinet (800) is shown. The adjustable levels (825) are accessible through the interior of the cabinet (800) (which incorporates the chassis (802) of FIG. 8B).

Figures 9A, 9B, 9C:
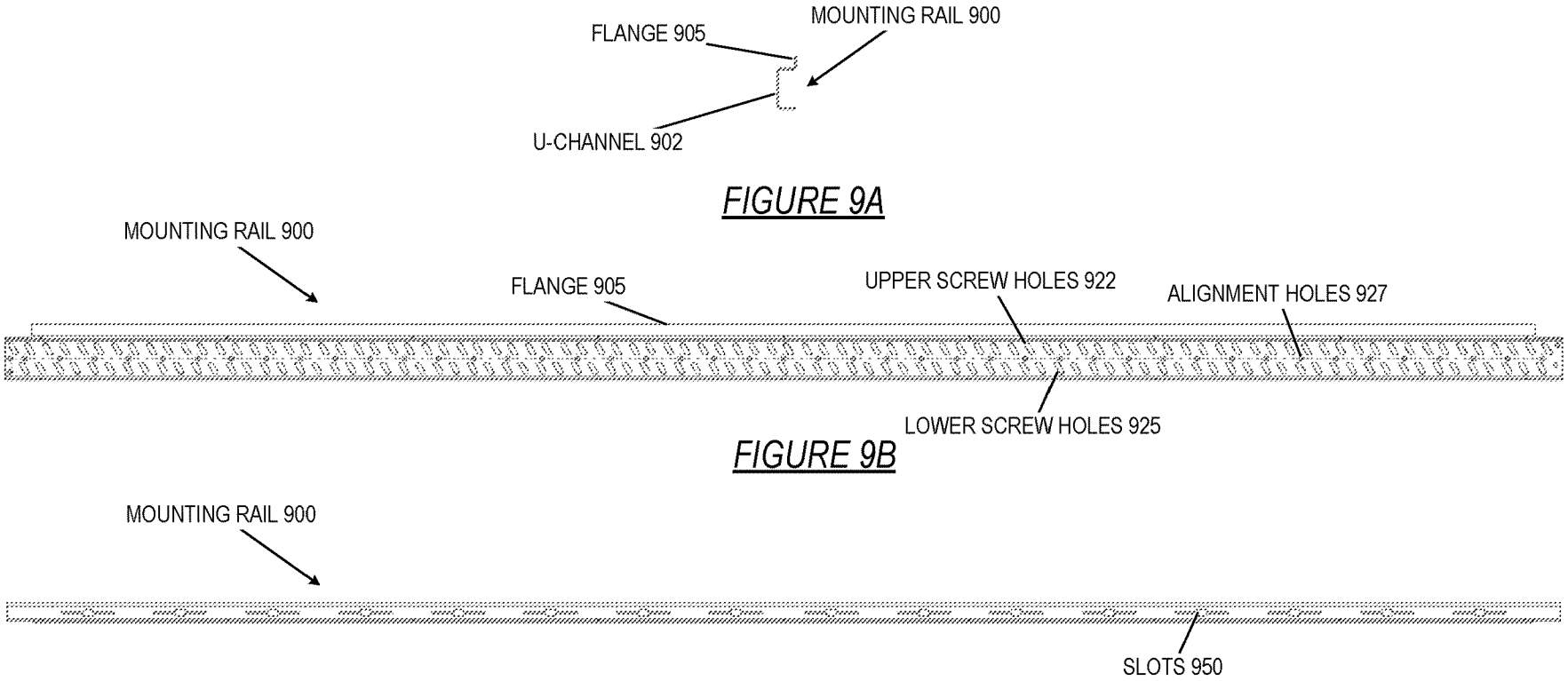

Turning to FIG. 9A, a side view of the mounting rail (900) is shown. The mounting rail (900) Includes the u-channel (902) with the flange (905). In one embodiment, the flange (905) may be formed on a top side of the mounting rail (900).

Turning to FIG. 9B, a front view of the mounting rail (900) with the flange (905) is shown. The set of upper screw holes (922) and the lower screw holes (925) are formed around the alignment holes (927). The upper screw holes (922) and the lower screw holes (925) are each large enough to fit multiple screws.

Turning to FIG. 9C, a top view of the mounting rail (900) is shown. Both sides of the u-channel (902) (see FIG. 9A) include the slots (950).

Figure 9D:
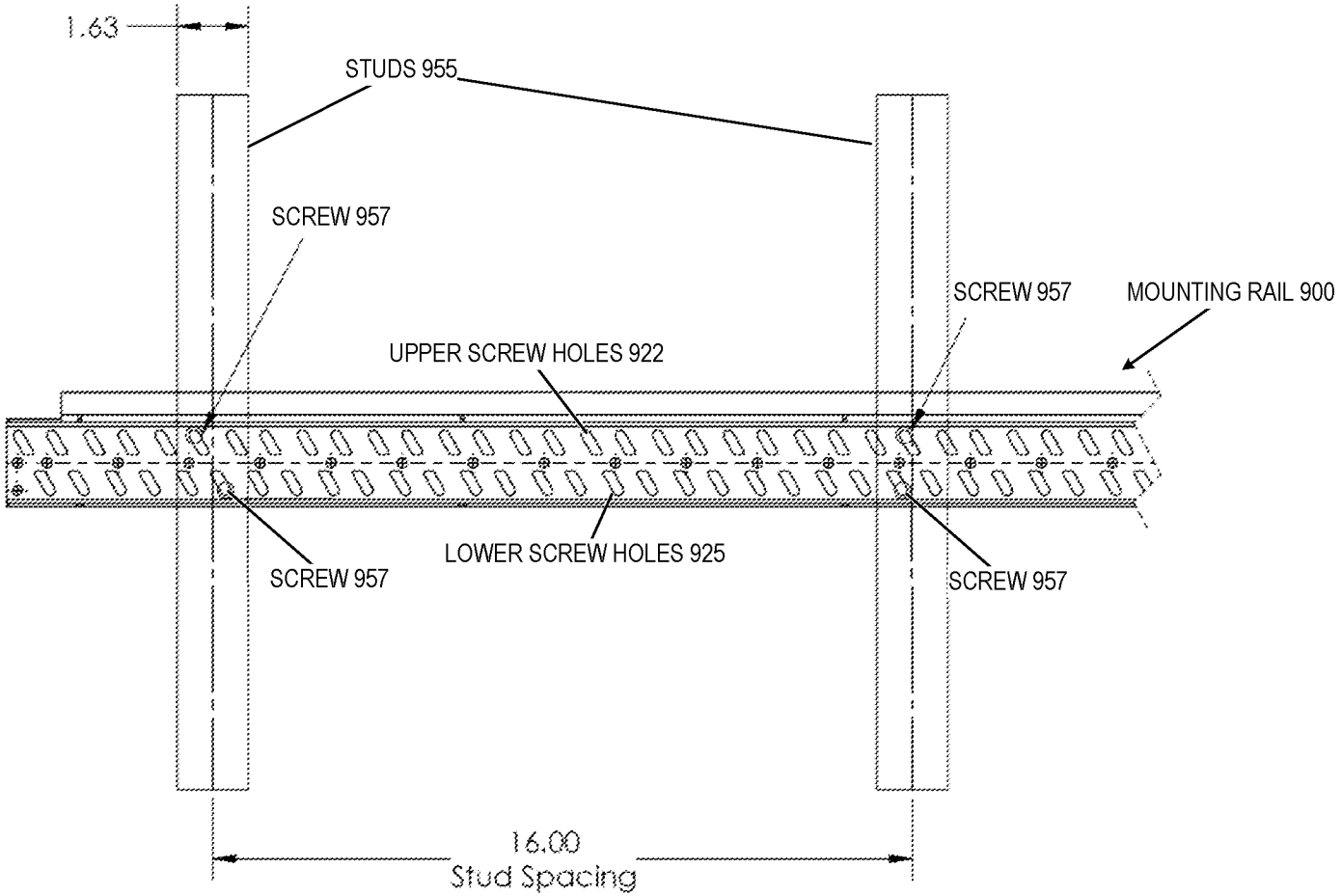

Turning to FIG. 9D, the mounting rail (900) is installed between the studs (955), which are spaced 16 inches apart. Different stud spacings may be used. The screws (957) are installed through the upper screw holes (922) and the lower screw holes (925) to the studs (955).

Figure 9E:
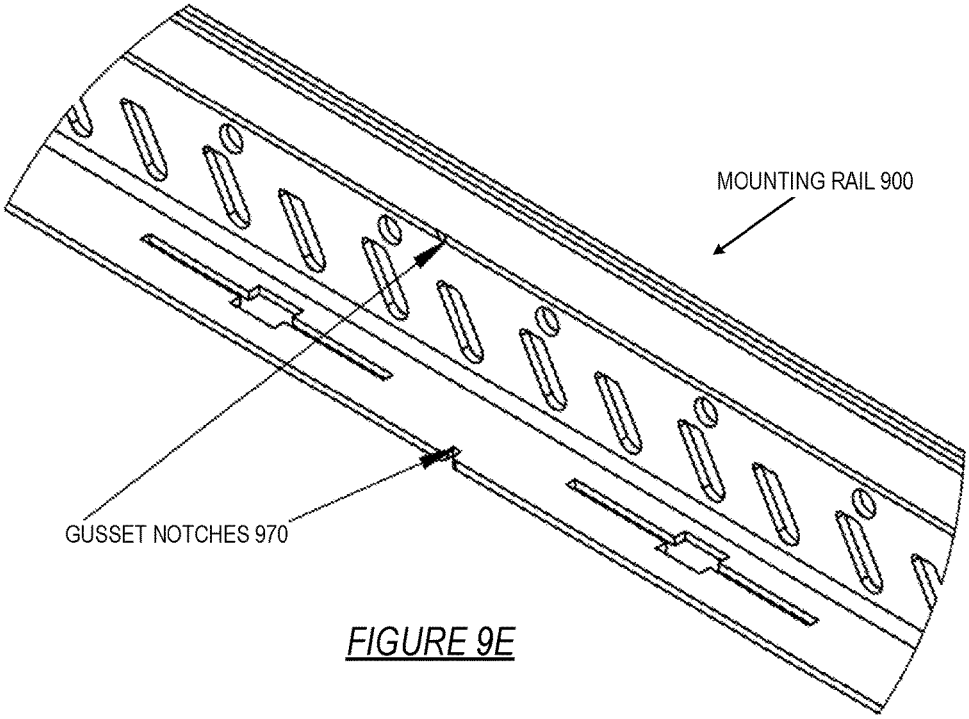

Turning to FIG. 9E a perspective view of the mounting rail (900) is shown. The mounting rail (900) includes the gusset notches (970) for receiving a gusset.

Figure 9F:
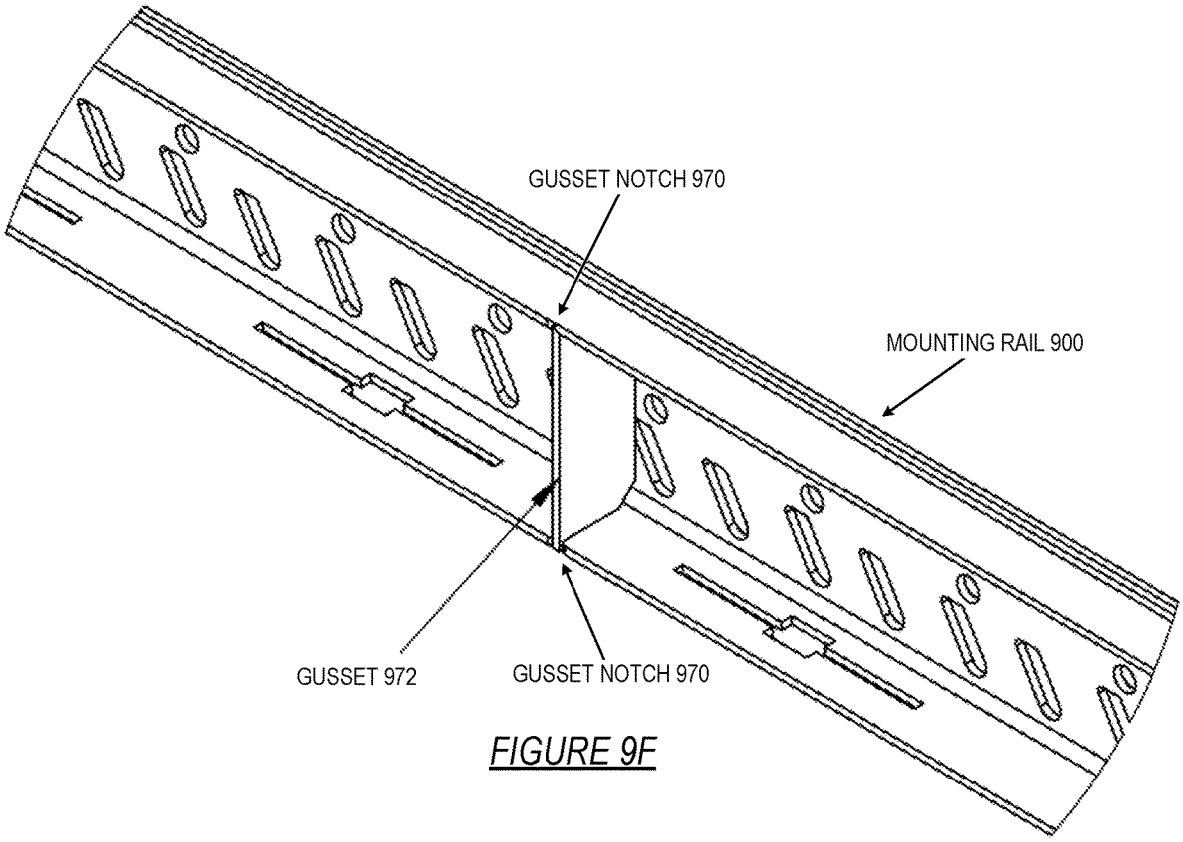

Turning to FIG. 9F, a perspective view of the mounting rail (900) is shown. The mounting rail (900) includes the gusset (972) installed into the gusset notches (970). In one embodiment, the gusset (972) may be welded to the mounting rail (900).

Figure 10A:
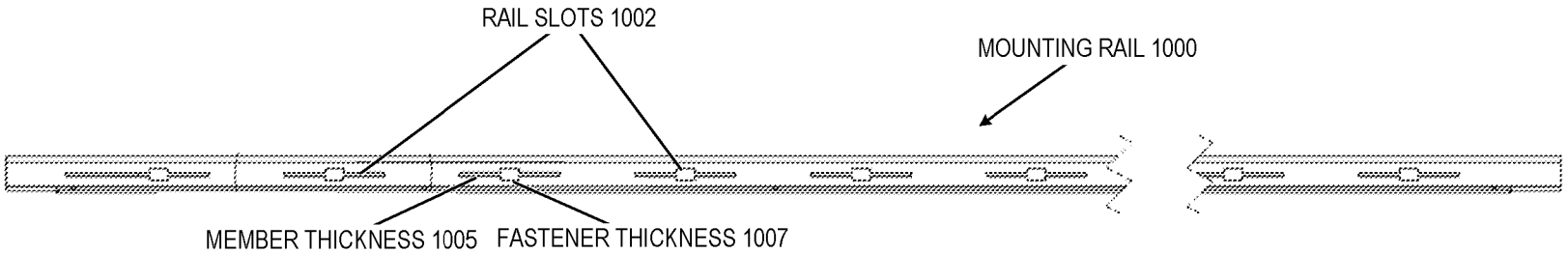

Turning to FIG. 10A, a top view of the mounting rail (1000) is shown. The mounting rail (1000) includes the rail slots (1002). Each of the rail slots (1002) includes a member thickness (1005) and a fastener thickness (1007). The fastener thickness (1007) is located towards the centers of the rail slots (1002) and is greater than the member thickness (1005).

Figure 10B:
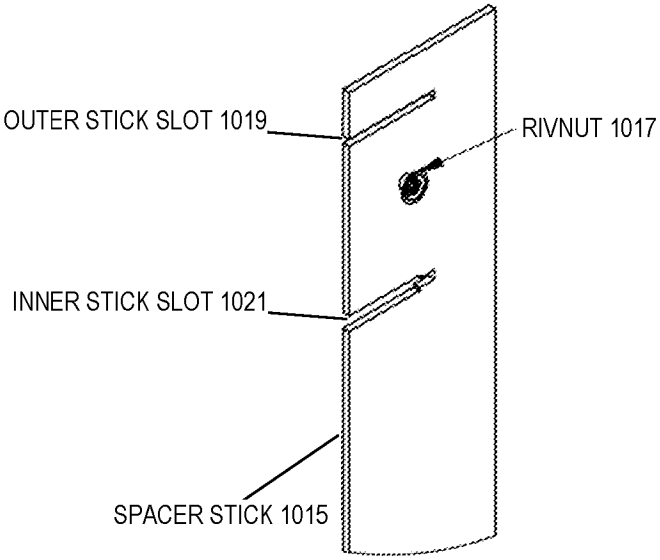

Turning to FIG. 10B, an end of the spacer stick (1015) is shown. The spacer stick (1015) includes the rivnut (1017), the outer stick slot (1019), and the lower stick slot (1021). The rivnut (1017) may receive a fastener (e.g., a screw) used to secure the spacer stick (1015) to the mounting rail (1000) of FIG. 10A. The outer stick slot (1019) and the inner stick slot (1021) are structured to slide into and towards an end of the rail slots (1002) of FIG. 10A. The rivnut (1017) passes through the fastener thickness (1007) of the rail slot (1002) of FIG. 10A. The outer stick slot (1019) may have a small thickness than the inner stick slot (1021). In one embodiment, the thickness of the outer stick slot (1019) is about one fourth the thickness of the inner stick slot (1021). The increased thickness of the inner stick slot (1021) increases the tolerances for the construction of the mounting rail (1000) of FIG. 10A.

Figure 10C:
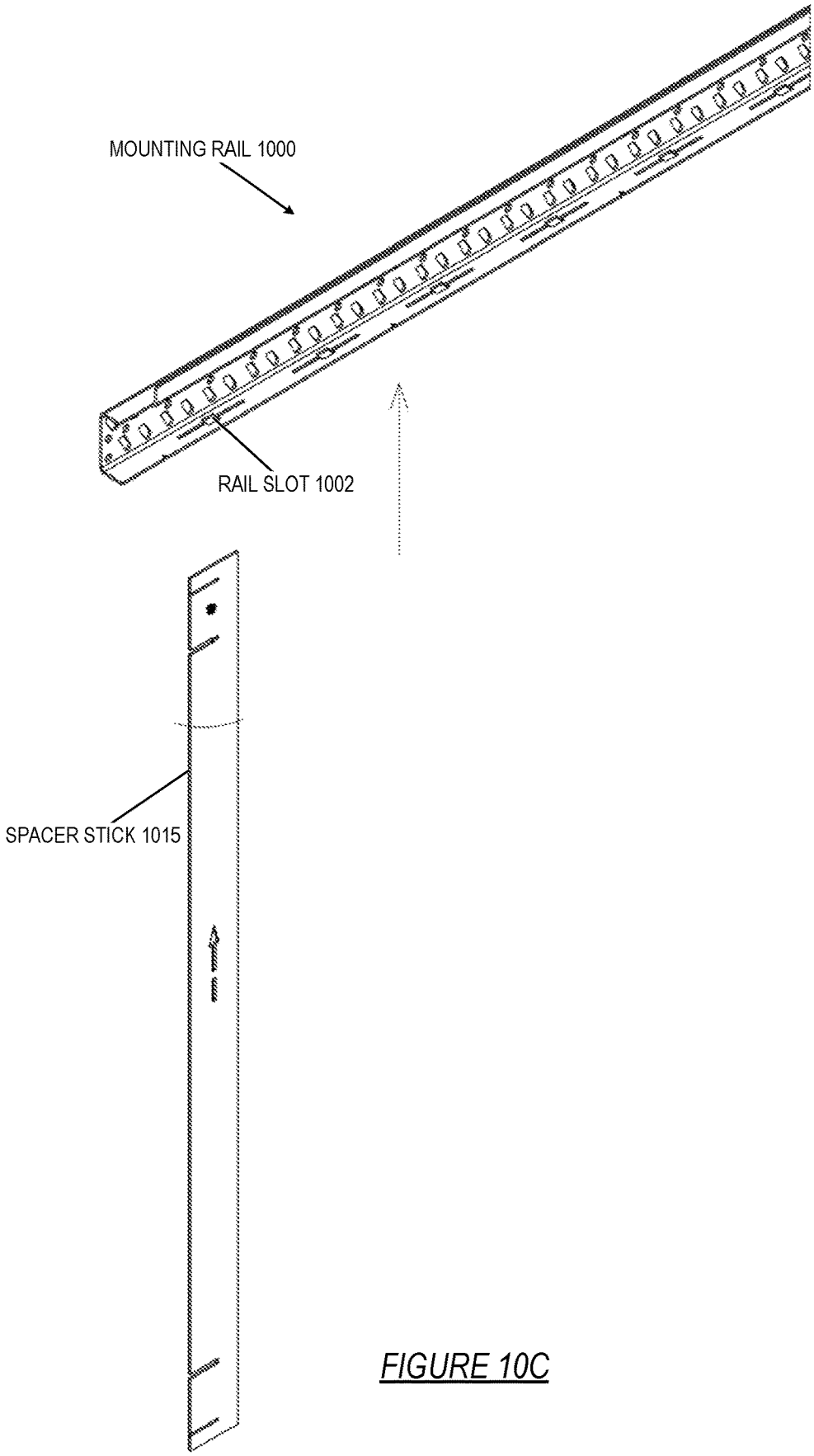

Turning to FIG. 10C, the spacer stick (1015) is shown prior to insertion into the rail slot (1002) of the mounting rail (1000). Both ends of the spacer stick (1015) include inner and outer slots for vertically spacing and aligning multiple mounting rails.

Figure 10D:
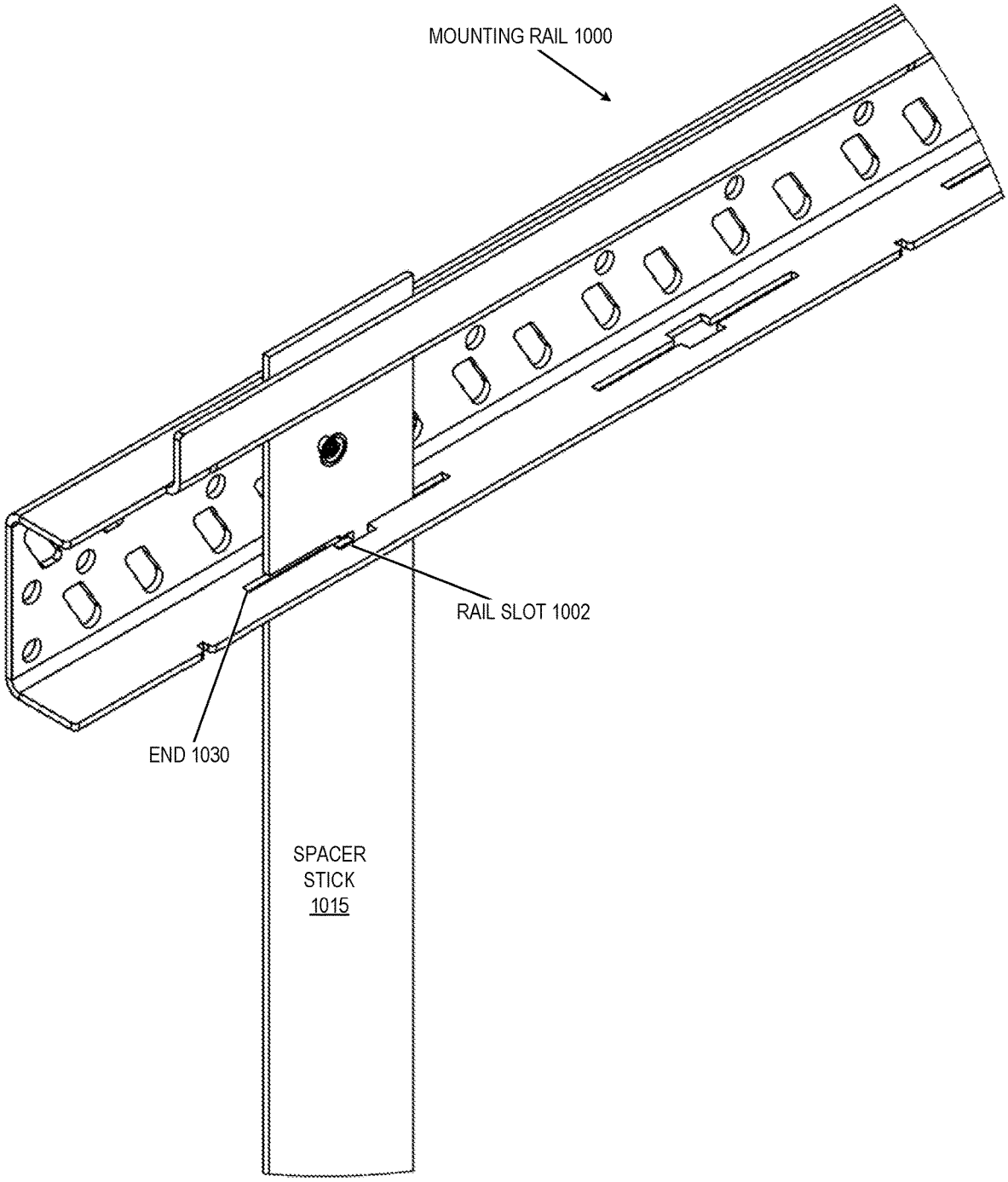

Turning to FIG. 10D, the spacer stick (1015) is shown after initial insertion. The spacer stick (1015) is inserted into the rail slot (1002) of the mounting rail (1000) and has not been moved to the end (1030) of the rail slot (1002).

Figure 10E:
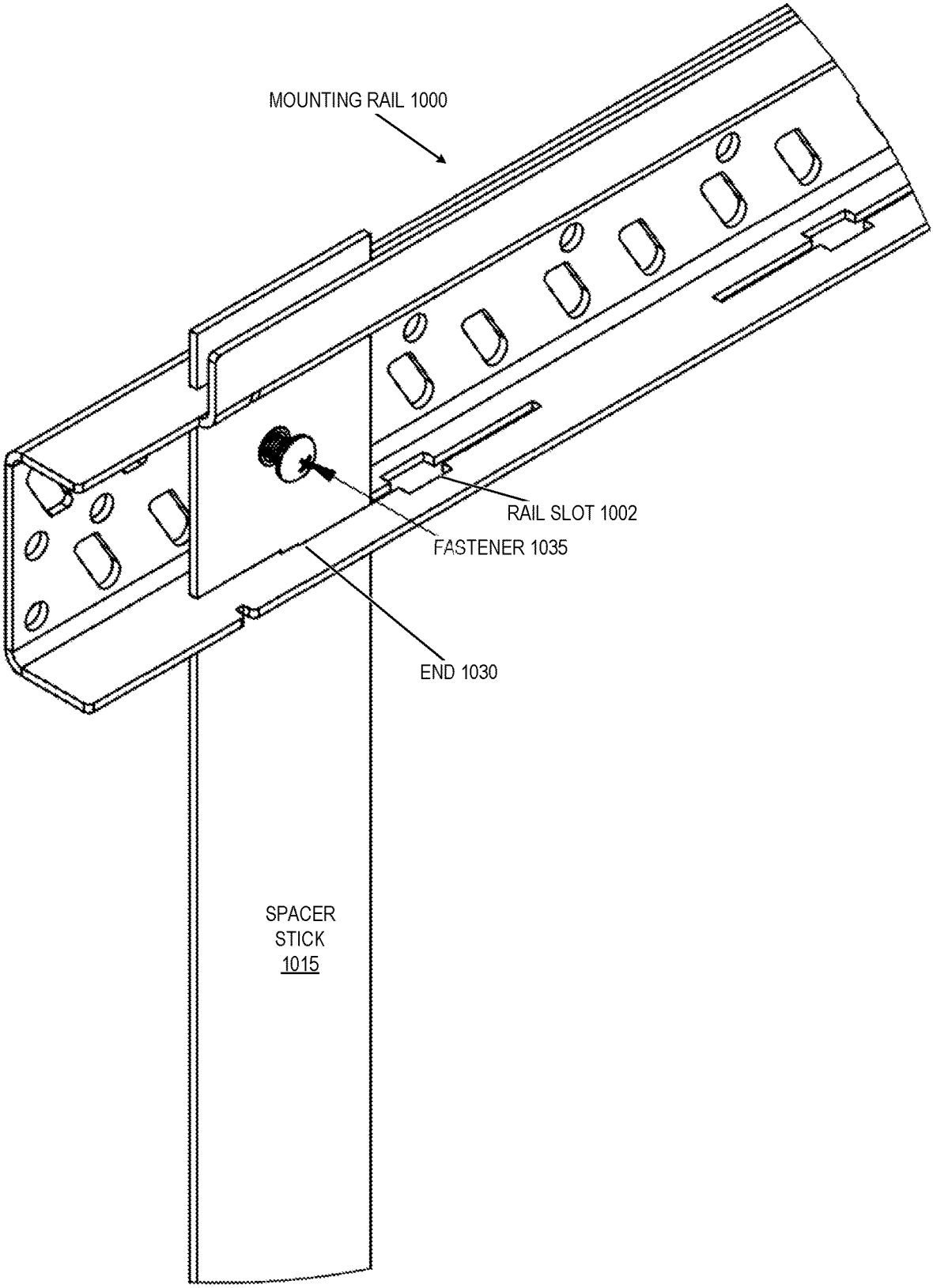

Turning to FIG. 10E, the spacer stick (1015) is inserted through the lower slot (1002) and an occluded upper slot of the mounting rail (1000). After insertion to the slots, the spacer stick (1015) is moved to the end (1030). After being moved to the end (1030), the fastener (1035) is inserted to secure the spacer stick (1015) to the mounting rail (1000).

Figure 10F:
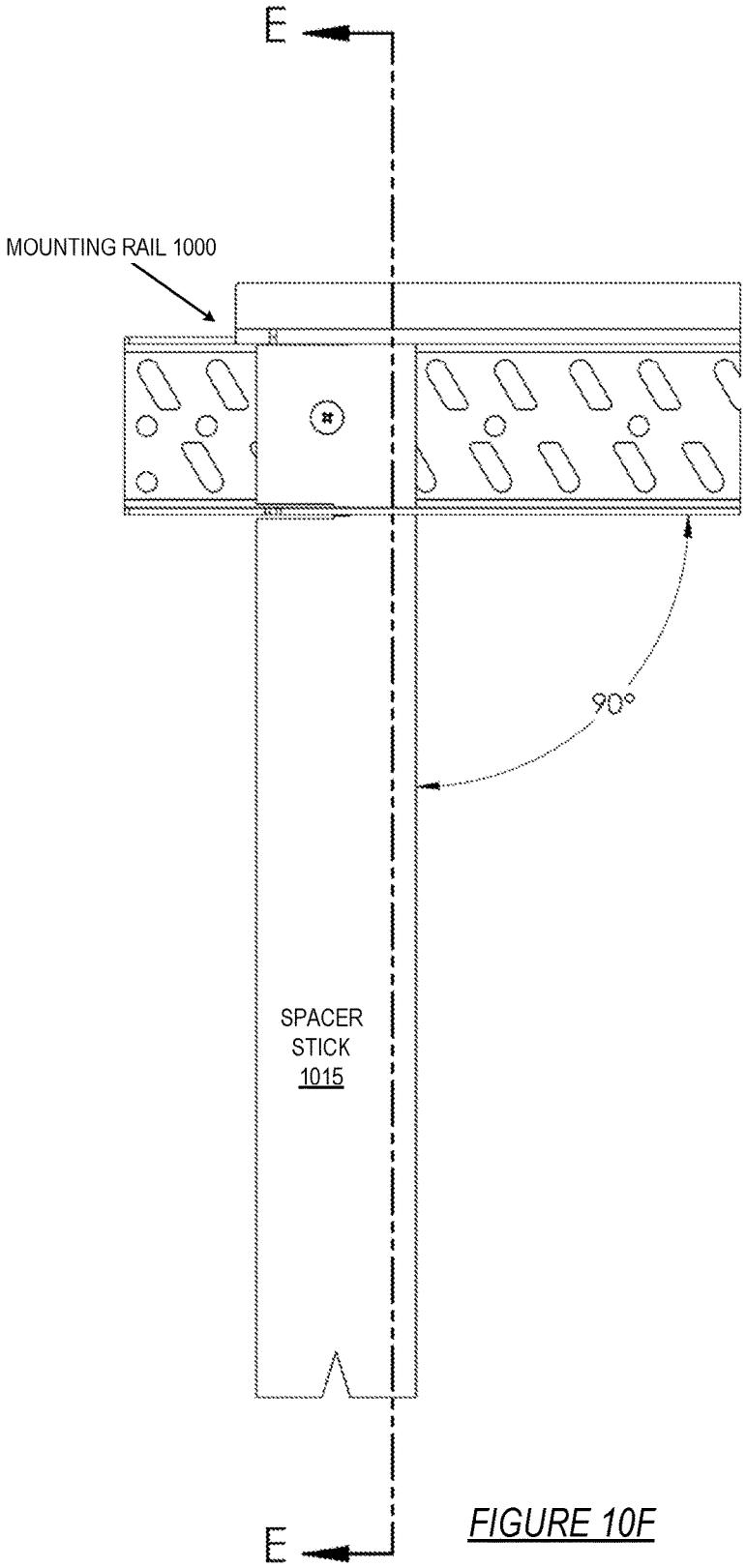

Turning to FIG. 10F, the spacer stick (1015) is inserted through the lower slot (1002) (see FIG. 10E) and an occluded upper slot of the mounting rail (1000). The spacer stick (1015) makes a right-angle with the mounting rail (1000).

Figure 10G:
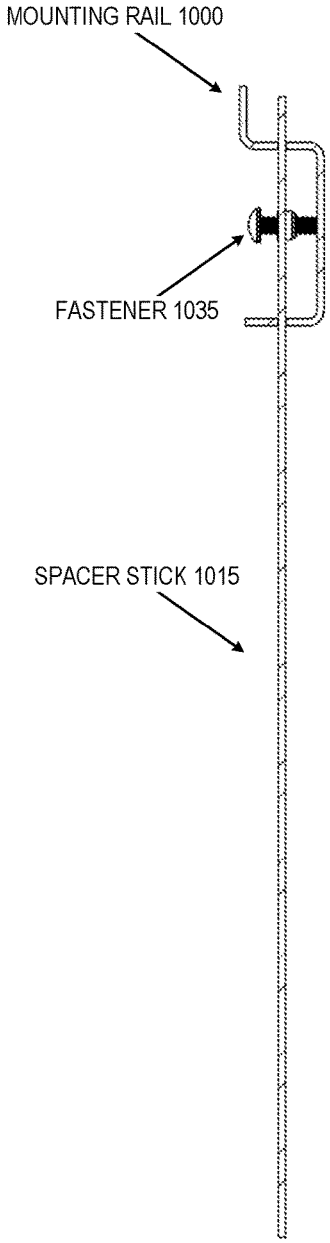

Turning to FIG. 10G, a side view of the mounting rail (1000), the spacer stick (1015), and the fastener (1035) is shown. The fastener (1035) extends through the spacer stick (1015) to contact the mounting rail (1000). In one embodiment, the fastener (1035) pushes the portion of the spacer stick (1015) proximate to the fastener (1035) away from the portion of the mounting rail (1000) contacting the fastener (1035).

Figure 11B:
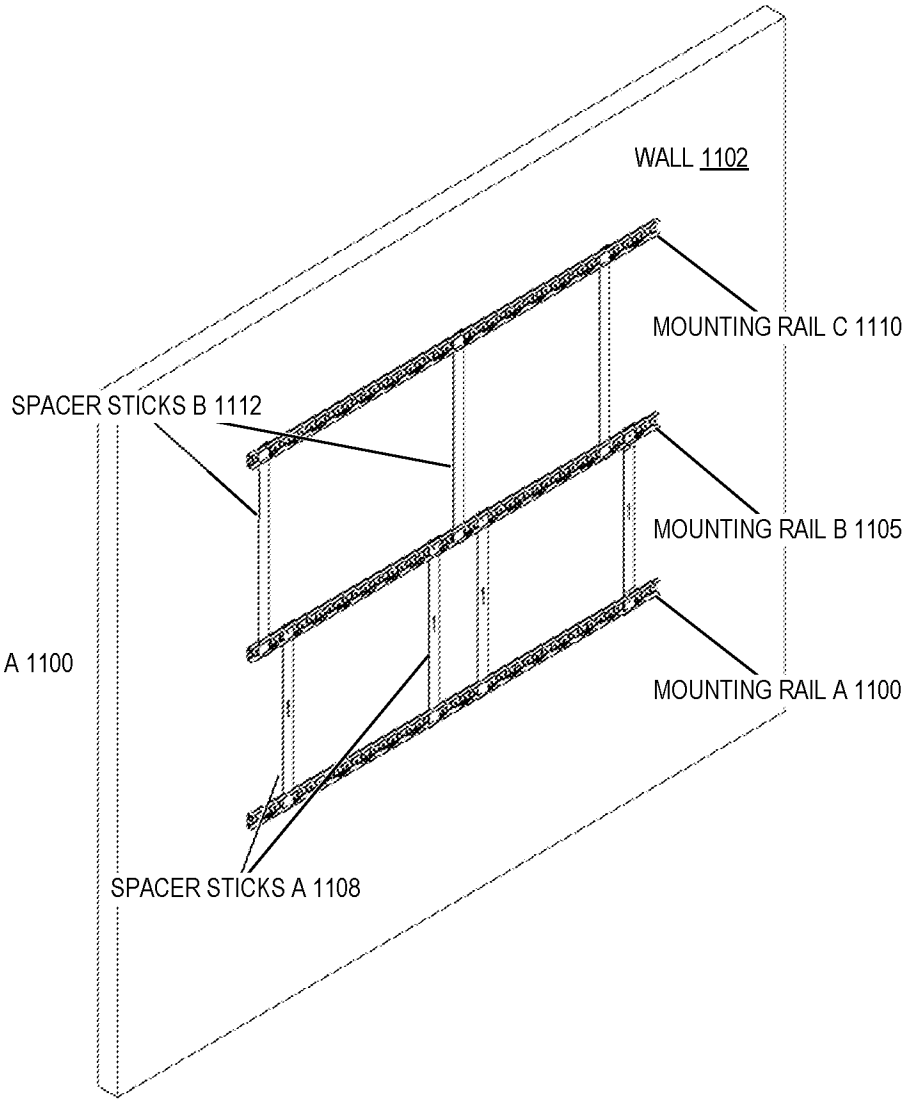
Figure 11A:
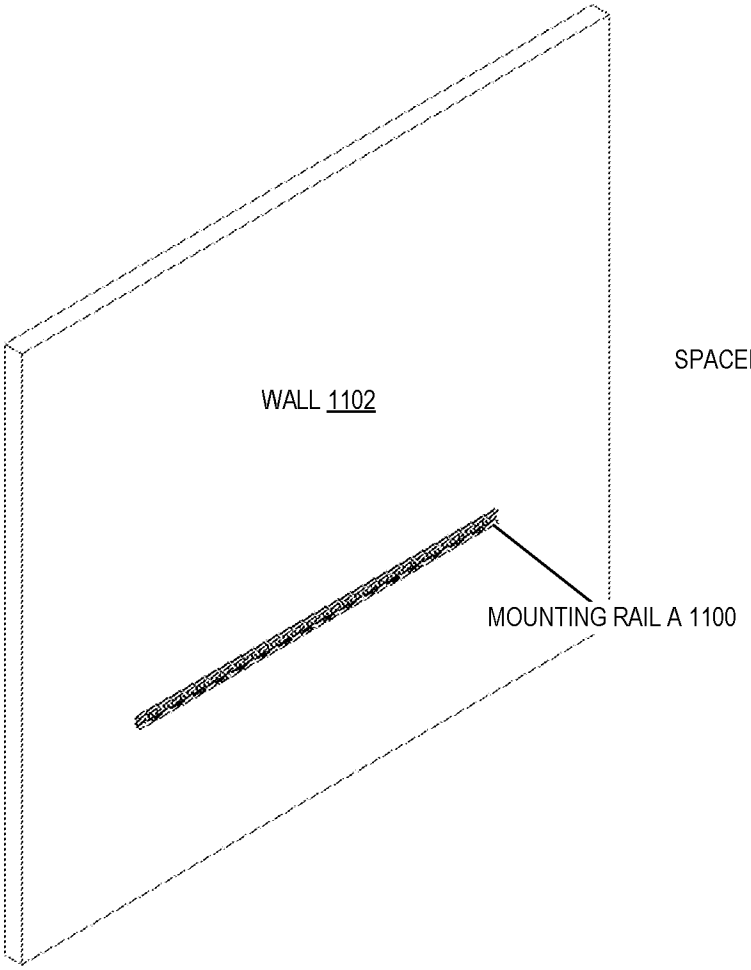

Turning to FIG. 11A, an initial installation step is shown. The mounting rail A (1100) is mounted to the wall (1102). The mounting rail A (1100) may be leveled with a laser level (not shown).

Turning to FIG. 11B, a subsequent installation step is shown. The mounting rail B (1105) is aligned to the mounting rail A (1100) with the spacer sticks A (1108) and may the be secured to the wall (1102). The mounting rail C (1110) is aligned to the mounting rail B (1105) with the spacer sticks B (1112) and may be secured to the wall (1102). The spacer sticks A (1108) and the spacer sticks B (1112) may be placed symmetrically about the mounting rails A (1100), B (1105), and C (1110).

Figure 11D:
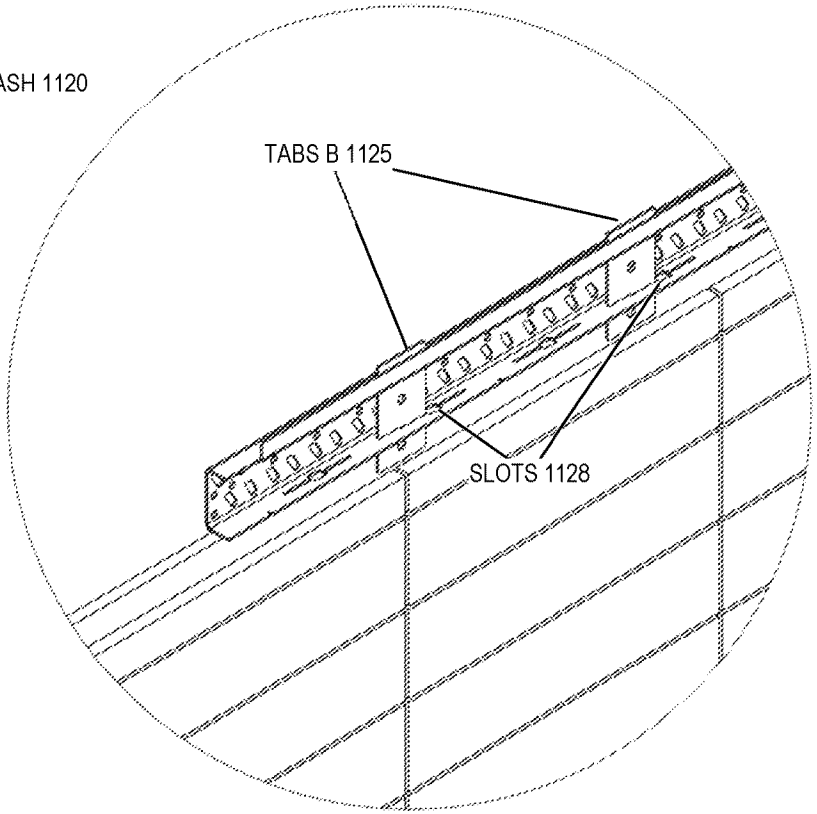
Figure 11C:
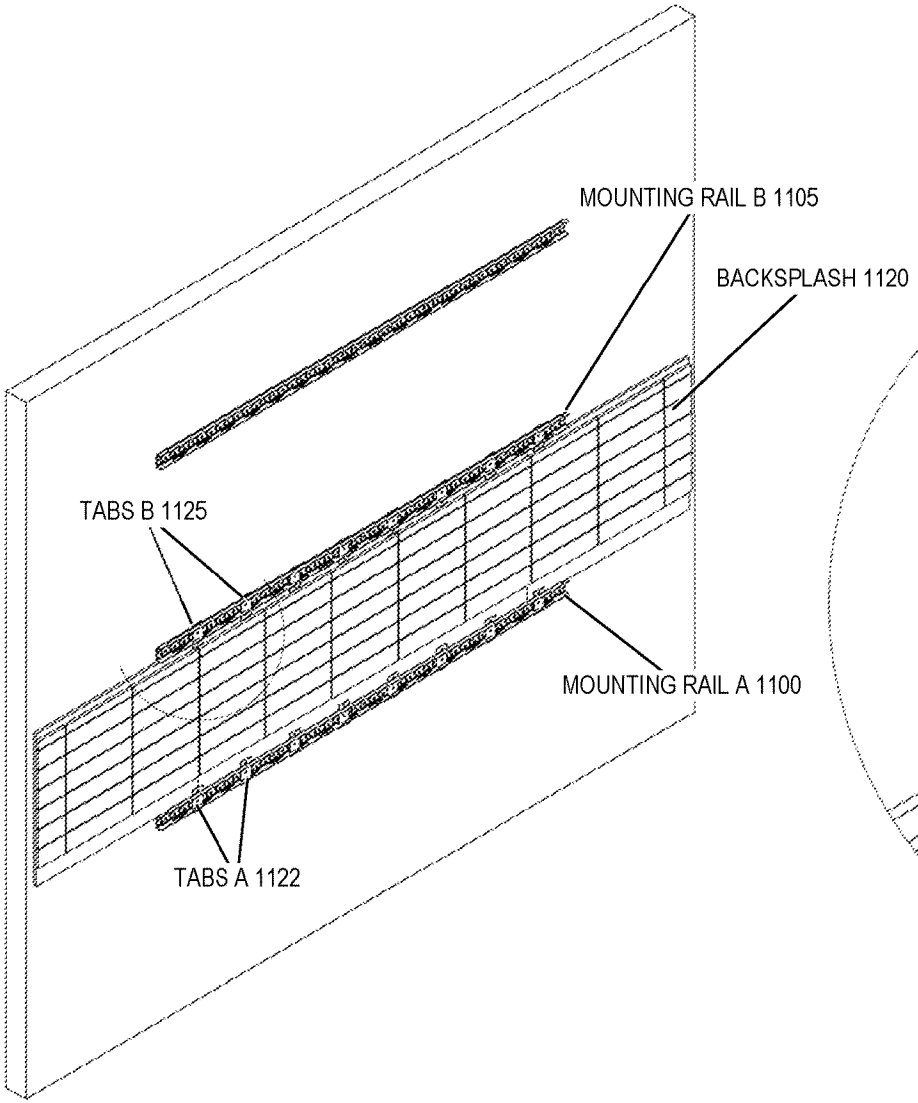

Turning to FIG. 11C, the backsplash (1120) is mounted between the mounting rail A (1100) and the mounting rail B (1105). The backsplash (1120) is mounted using the tabs A (1122) to secure the backsplash (1120) to the mounting rail A (1100) and the tabs B (1125) to secure the backsplash (1120) to the mounting rail B (1105).

Turning to FIG. 11D, the tabs B (1125) are inserted through the slots (1128) in the top (occluded) and bottom of the mounting rail B (1105). After insertion, the tabs B (1125) are slid to an end of the slots (1128).

Figure 11E:
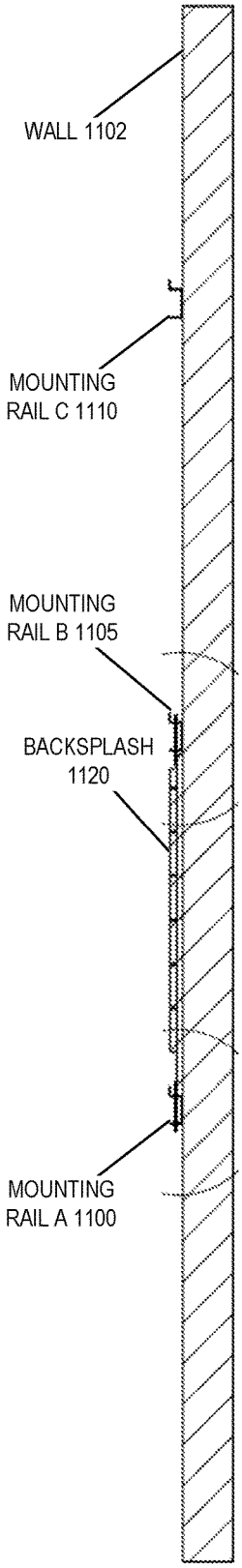

Turning to FIG. 11E, a side view is shown. The mounting rail C (1110) is mounted to the wall (1102) above the mounting rail B (1105). The backsplash (1120) is secured between the mounting rail A (1100) and the mounting rail B (1105), which are secured to the wall (1102).

Figure 11F:
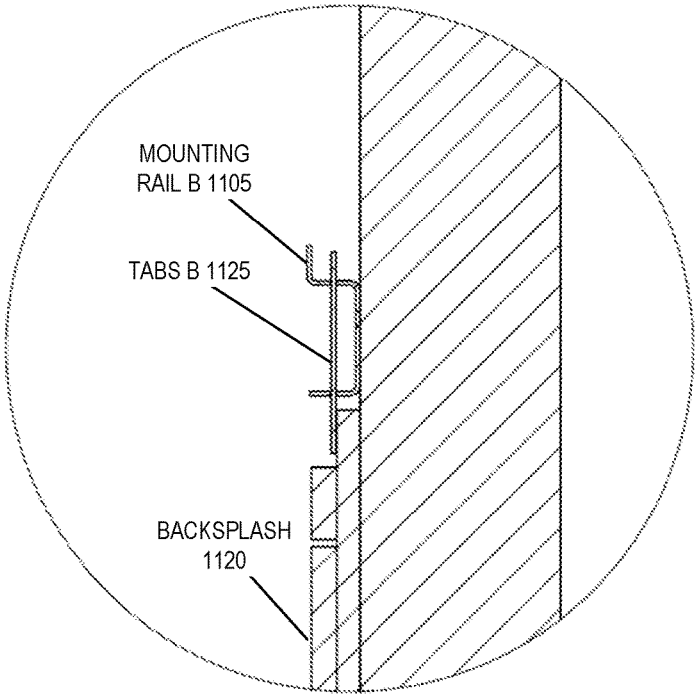

Turning to FIG. 11F, a view of the mounting rail B (1105) is shown. The tabs B (1125) are inserted into the mounting rail B (1105) and support the backsplash (1120).

Figure 11G:
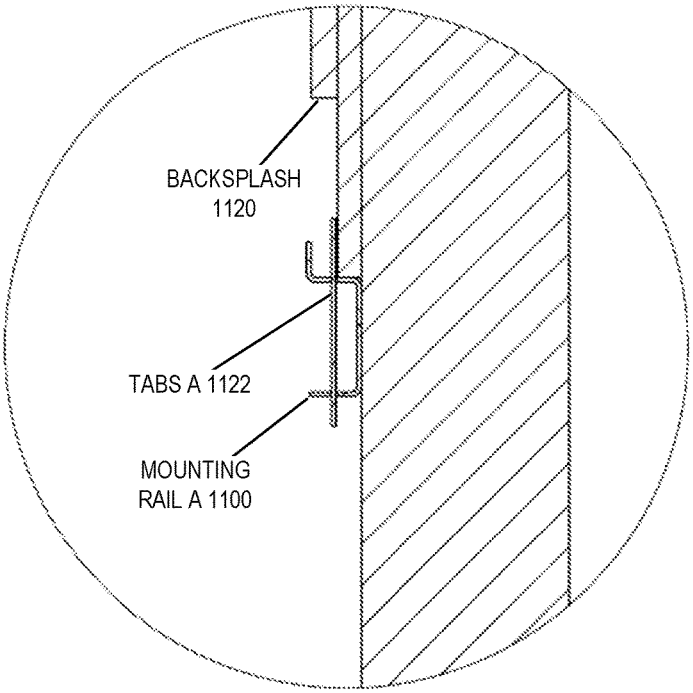

Turning to FIG. 11G, a view of the mounting rail A (1100) is shown. The tabs A (1122) are inserted into the mounting rail A (1100) and support the backsplash (1120).

Figure 12A:
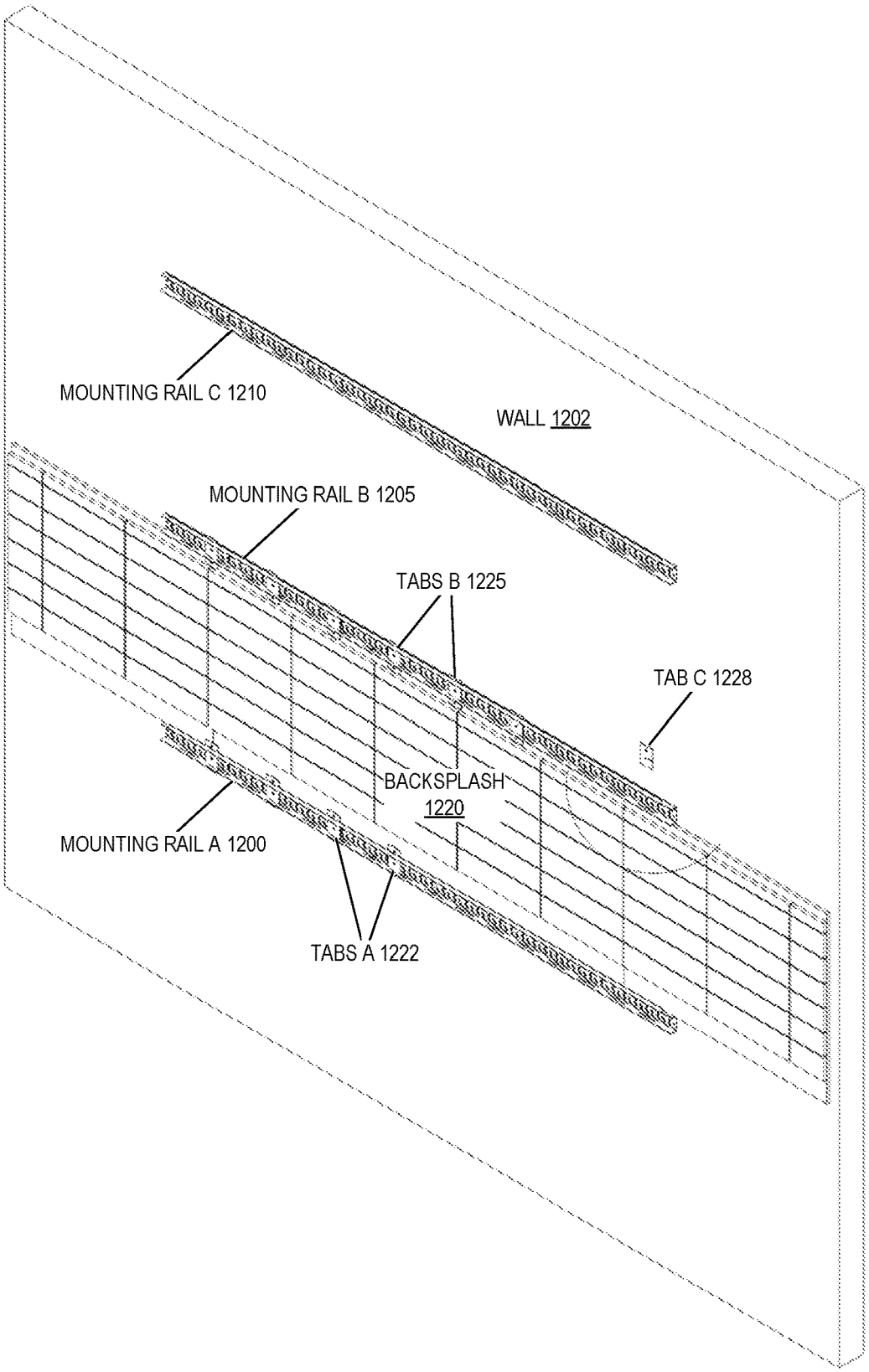

Turning to FIG. 12A, the tab C (1228) is used in addition to the tabs A (1222) and the tabs B (1225) to secure the backsplash (1220) to mounting rails A (1200) and B (1205). The mounting rails A (1200), B (1205), and C (1210) are secured to the wall (1202).

Figure 12B:
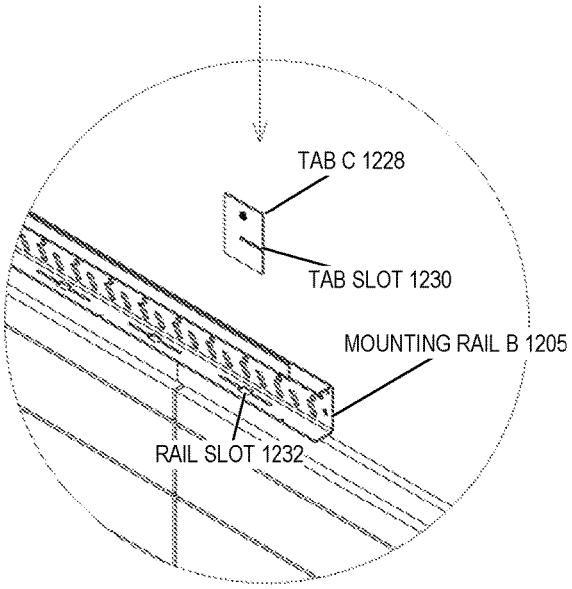

Turning to FIG. 12B, the tab C (1228) is not as long in the longitudinal direction as the tabs A (1222) and B (1225) of FIG. 12A. The tab C (1228) includes the single tab slot (1230) that engages in a bottom rail slot (1232) of the mounting rail B (1205) but not to a top slot (occluded) of the mounting rail B (1205).

Figure 12C:
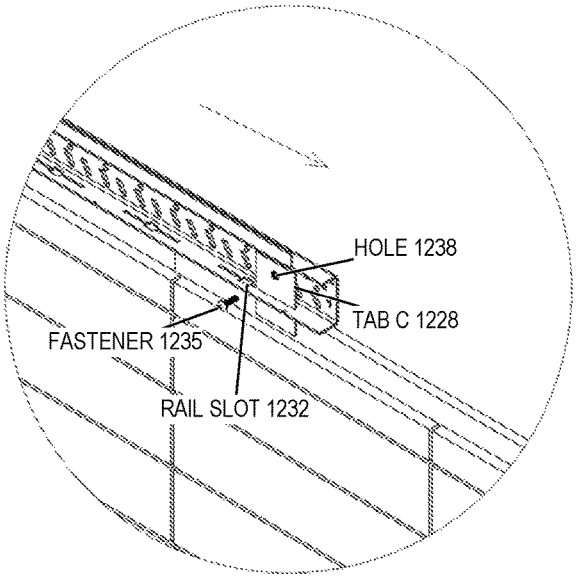

Turning to FIG. 12C, the tab C (1228) is inserted through the rail slot (1232) and slid to an outer end of the rail slot (1232). After inserting the tab C (1228), the fastener (1235) may be inserted through the hole (1238) of the tab C (1228).

Figure 12D:
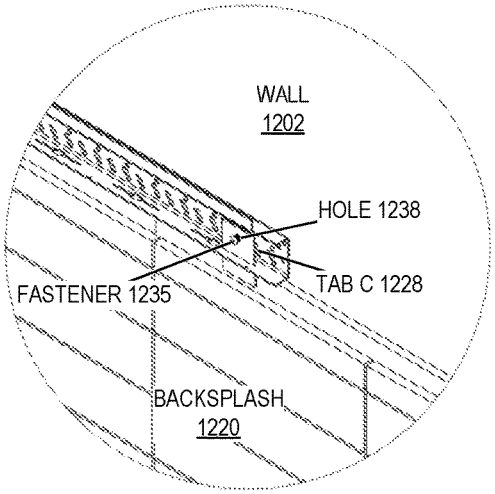

Turning to FIG. 12D, the fastener (1235) is inserted through the hole (1238) of the tab C (1228). The tab C (1228) secures the backsplash (1220) to the wall (1202).

Figure 12E:
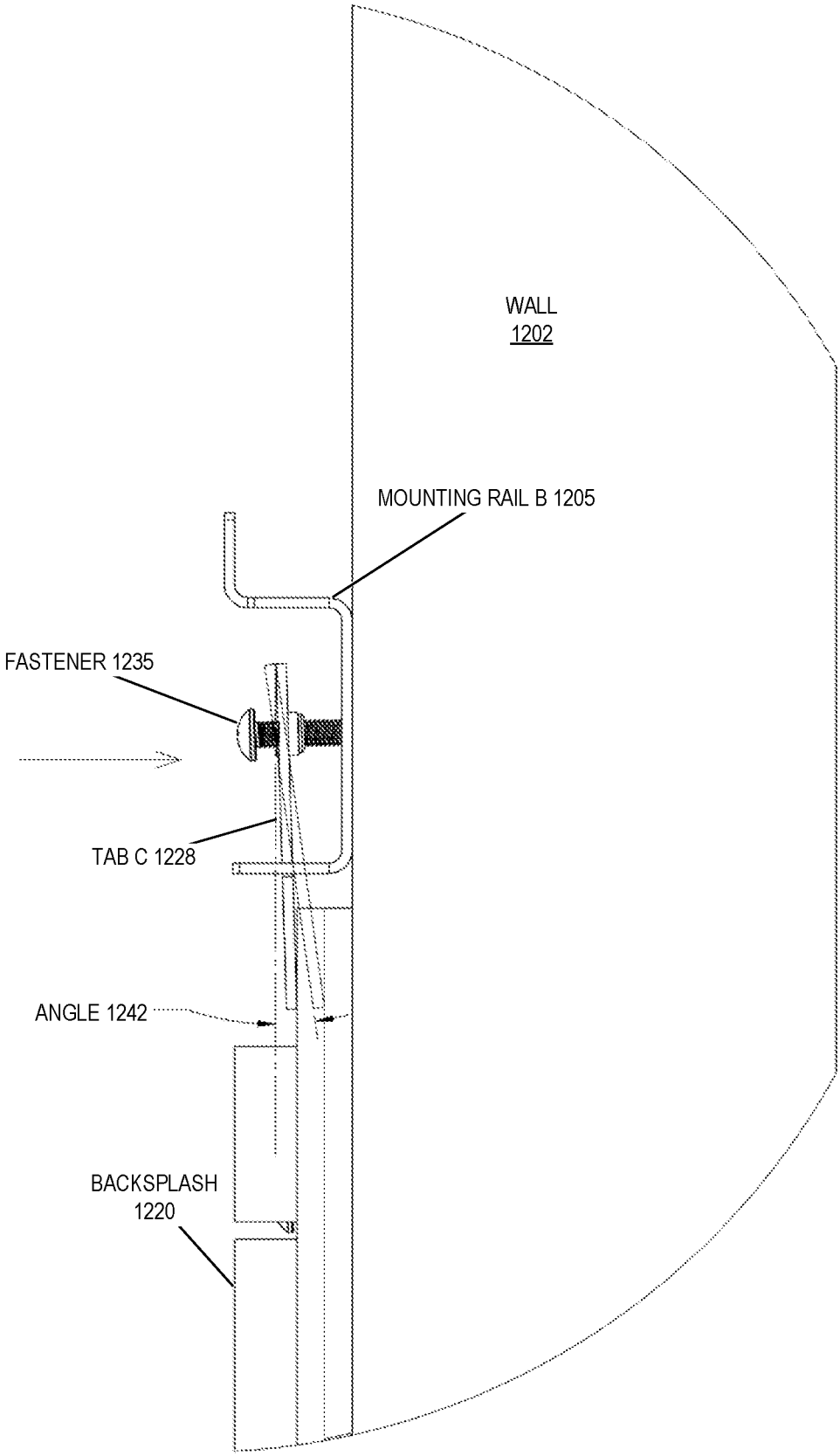

Turning to FIG. 12E, a side view is shown. The tab C (1228) is adjustable to secure backsplashes of different depths (including the backsplash (1220)) to the wall (1202). After inserting the tab C (1228) through the bottom rail slot (occluded, see the rail slot (1232) of FIG. 12C) of the mounting rail B (1205), the fastener (1235) is inserted and may be used to control the angle (1242) between the tab C (1228) and the mounting rail B (1205). Raising the portion of the tab C (1228) proximate to the fastener (1235) with respect to the mounting rail B (1205) may be used to secure thinner backsplashes. Lowering the portion of the tab C (1228) proximate to the fastener (1235) with respects to the mounting rail B (1205) may be used to secure thicker backsplashes.

Figure 13A:
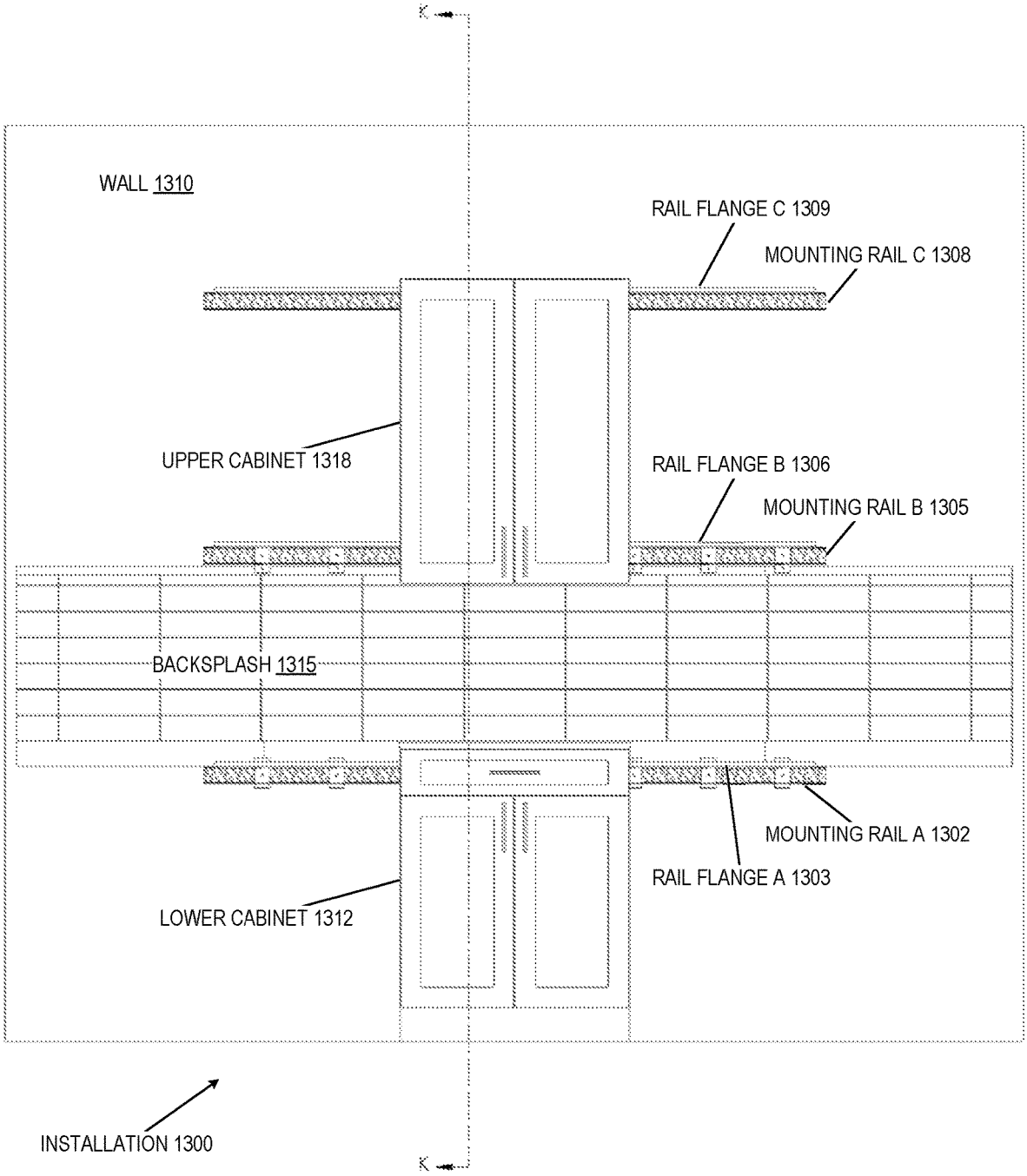

Turning to FIG. 13A, a front view of the installation (1300) is shown. The mounting rails A (1302), B (1305), and C (1308) are secured to the wall (1310). The lower cabinet (1312) is secured to the mounting rail A (1302). The backsplash (1315) is secured between the mounting rails A (1302) and B (1305). The upper cabinet (1318) is secured to the mounting rails B (1305) and C (1308). The mounting rail C (1308) includes the rail flange C (1309), the mounting rail B (1305) includes the rail flange B (1306), and the mounting rail A (1302) includes the rail flange A (1303).

Figure 13B:
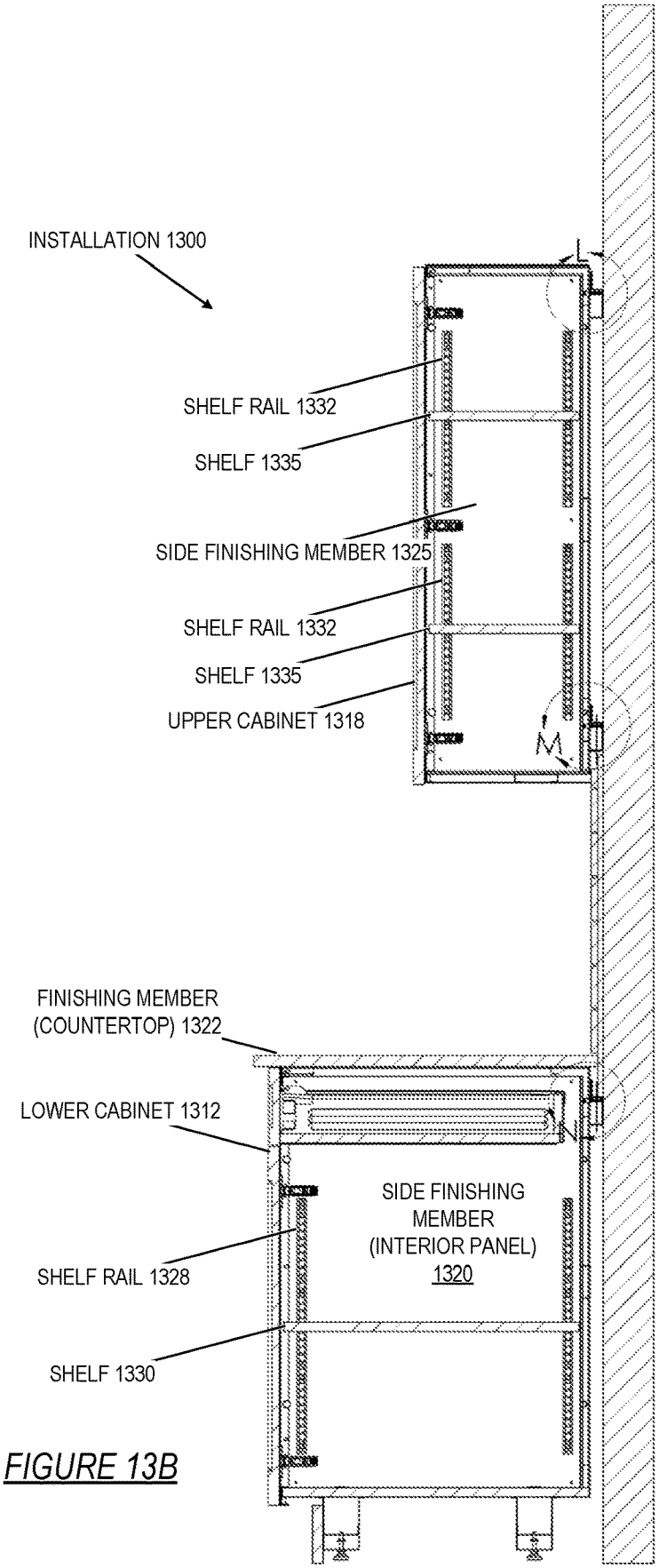

Turning to FIG. 13B, a side view cutaway of the installation (1300) is shown. The side finishing member (1320), which is an interior panel of the lower cabinet (1312) that includes the two shelf rails (1328) to which the shelf (1330) is installed. The lower cabinet (1312) also includes the finishing member (1322), which is a countertop of the lower cabinet (1312). The upper cabinet (1318) includes the side finishing member (1325), which is an interior panel of the upper cabinet (1318) that includes the four shelf rails (1332) to which the two shelves (1335) are installed.

Figure 13D:
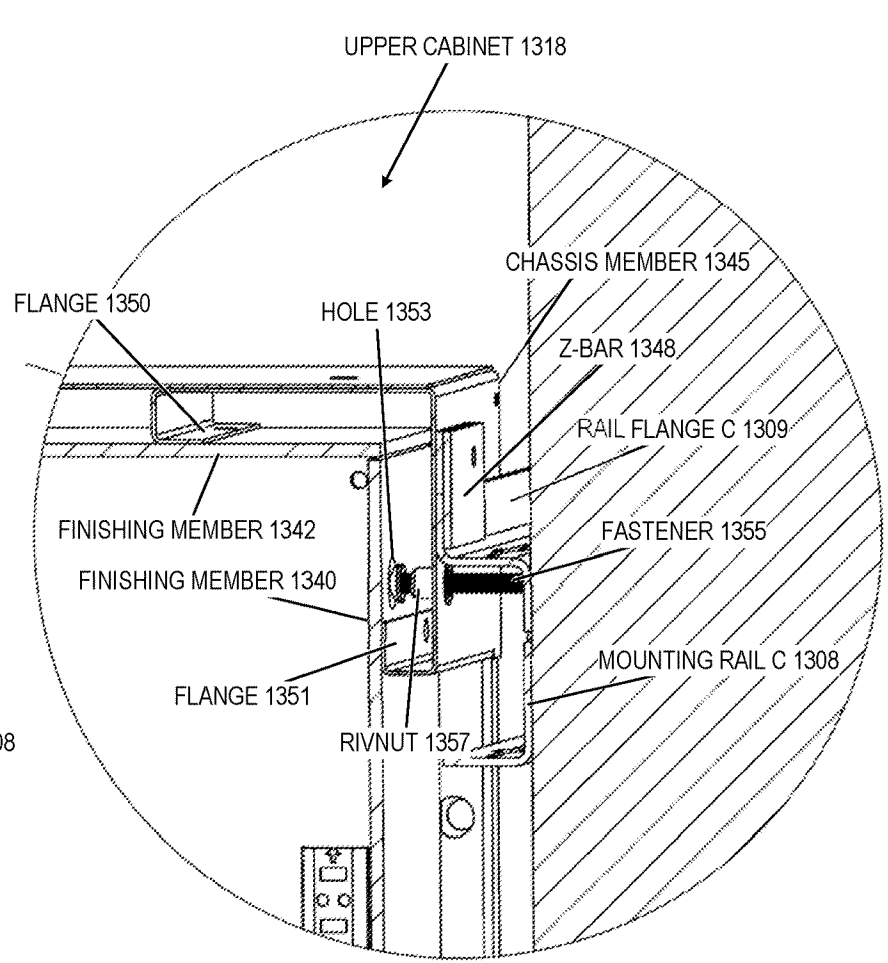
Figure 13C:
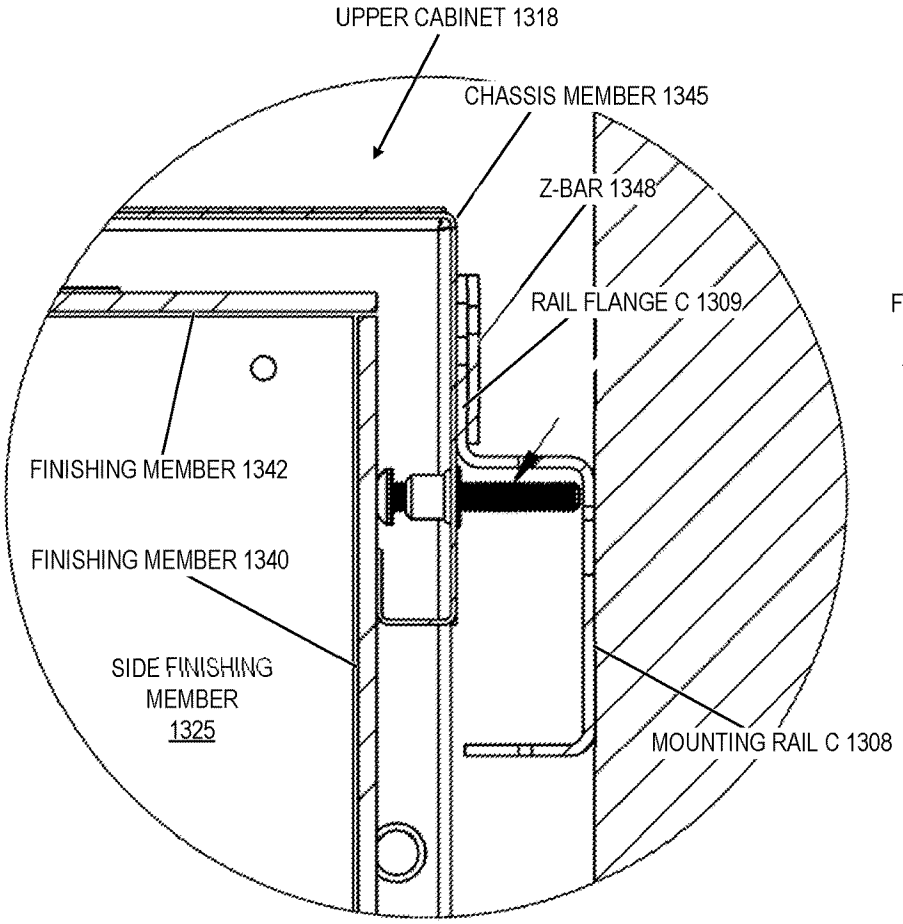

Turning to FIG. 13C, a side view of the upper cabinet (1318) is shown. The upper cabinet (1318) includes the finishing members (1325), (1340), and (1342). The upper cabinet (1318) also includes the chassis member (1345), which includes the z-bar (1348). The z-bar (1348) connects to the rail flange C (1309) of the mounting rail C (1308) to secure the upper cabinet (1318) to the mounting rail C (1308).

Turning to FIG. 13D, a perspective view of the upper cabinet (1318) is shown. The chassis member (1345) includes multiple bends forming the flange (1350) to which the finishing member (1342) attaches and forming the flange (1351) to which the finishing member (1340) attaches. The finishing member (1340) includes the hole (1353) through which the fastener (1355) may be passed to be inserted into the rivnut (1357) of the chassis member (1345) and extending to the mounting rail C (1308). The fastener (1355) creates tension pushing the upper cabinet (1318) away from the mounting rail C (1308) causing the z-bar (1348) to push onto the rail flange C (1309) and secure the upper cabinet (1318).

Figure 13F:
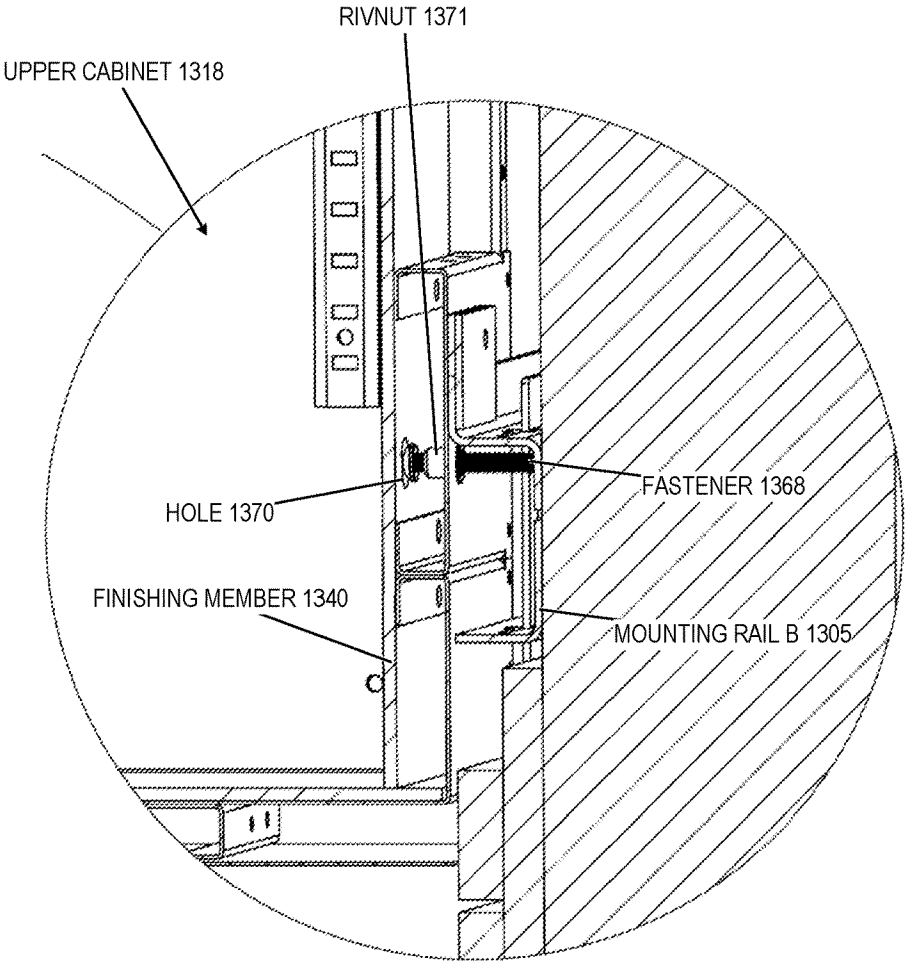
Figure 13E:
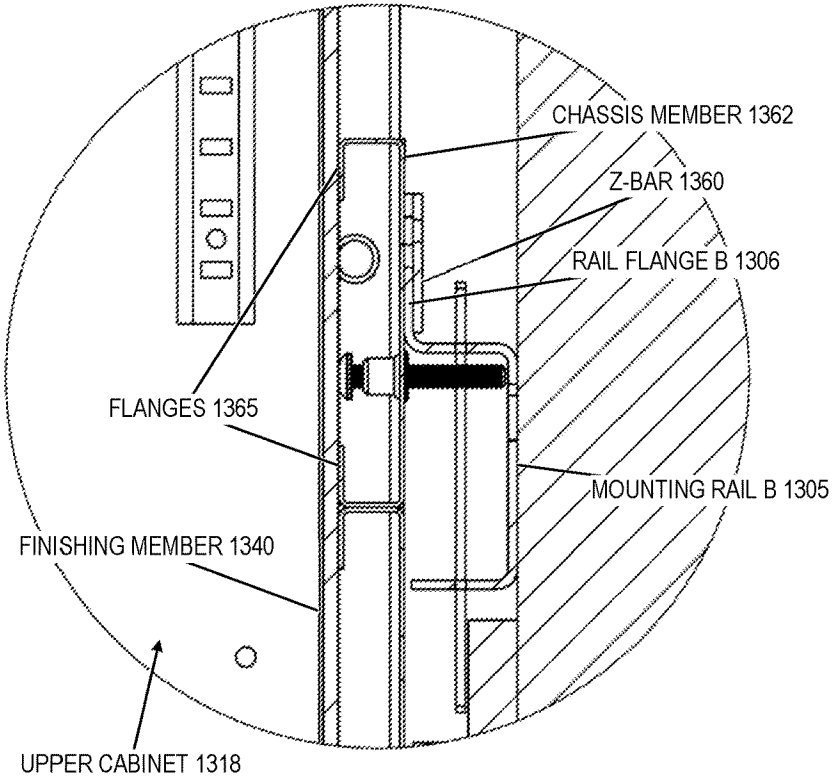

Turning to FIG. 13E, a side view of the upper cabinet (1318) is shown. The upper cabinet (1318) is secured to the rail B (1305) by the z-bar (1360) of the upper cabinet (1318) and the rail flange B (1306) of the rail B (1305). The chassis member (1362) includes multiple folds with the two flanges (1365) to support the finishing member (1340).

Turning to FIG. 13F, a side perspective view of the upper cabinet (1318) is shown. The fastener (1368) is inserted through the hole (1370) of the finishing member (1340) to engage the rivnut (1371) and the rail B (1305). Engagement with the rivnut (1371) and the rail B (1305) provides tension to secure the upper cabinet (1318) to the rail B (1305). The rivnut (1371) is a fastening member that is threaded and structured to receive a screw.

Figure 13H:
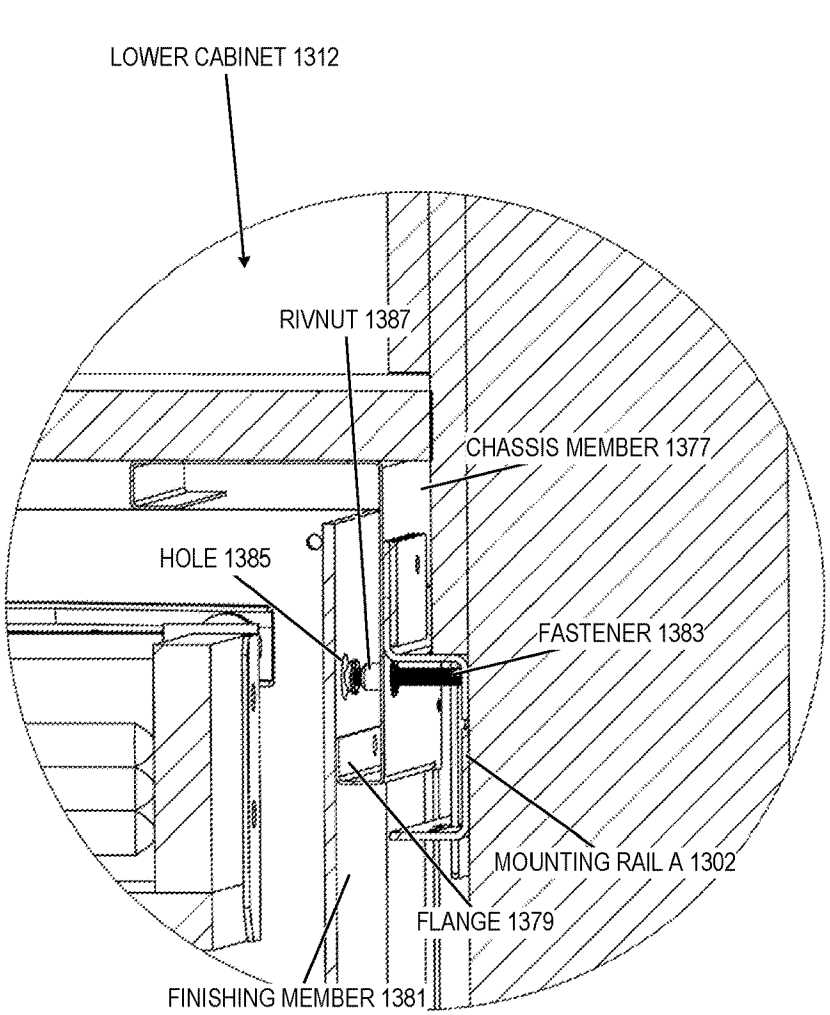
Figure 13G:
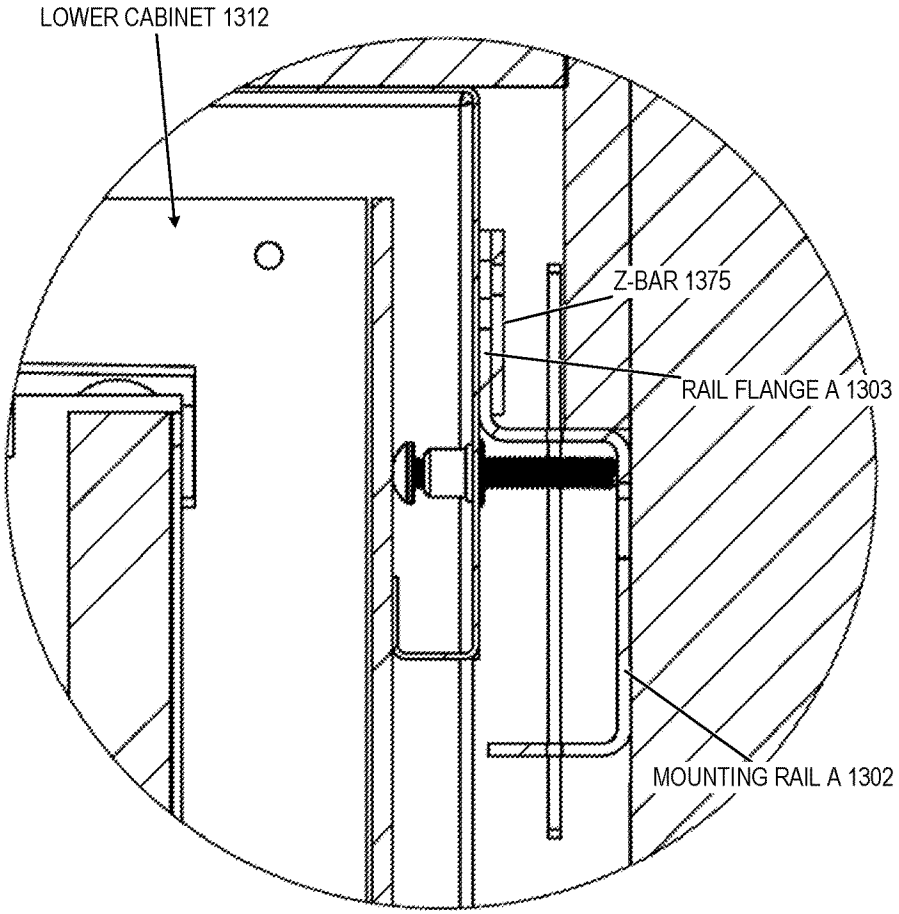

Turning to FIG. 13G, a side view of the lower cabinet (1312) is shown. The lower cabinet (1312) is secured to the mounting rail A (1302) by the z-bar (1375) of the lower cabinet (1312) and the rail flange A (1303) of the mounting rail A (1302).

Turning to FIG. 13H, a side perspective view of the lower cabinet (1312) is shown. The chassis member (1377) includes multiple folds and flanges with the flange (1379) to support the finishing member (1381). The fastener (1383) is inserted through the hole (1385) of the finishing member (1381) to engage the rivnut (1387) and the mounting rail A (1302). Engagement with the rivnut (1387) and the mounting rail A (1302) provides tension to secure the lower cabinet (1312) to the mounting rail A (1302).

Figure 14:
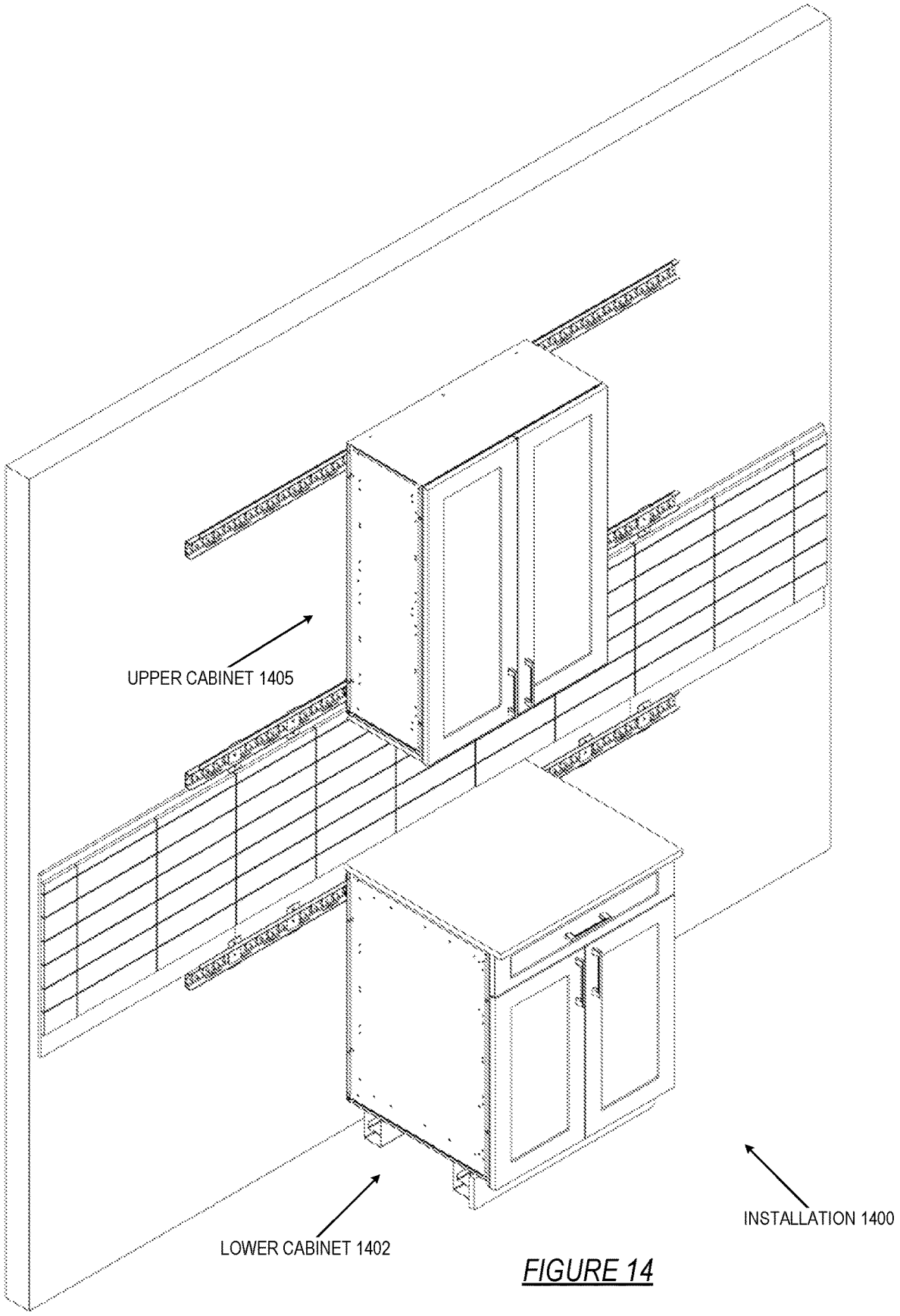

Turning to FIG. 14, the installation (1400) is updated from the installation (1300) of FIGS. 13A through 13H to have the lower cabinet (1402) and the upper cabinet (1405) installed. Side panel finishing members or additional cabinets may be added to the sides of the lower cabinet (1402) and the upper cabinet (1405).

Figure 15:
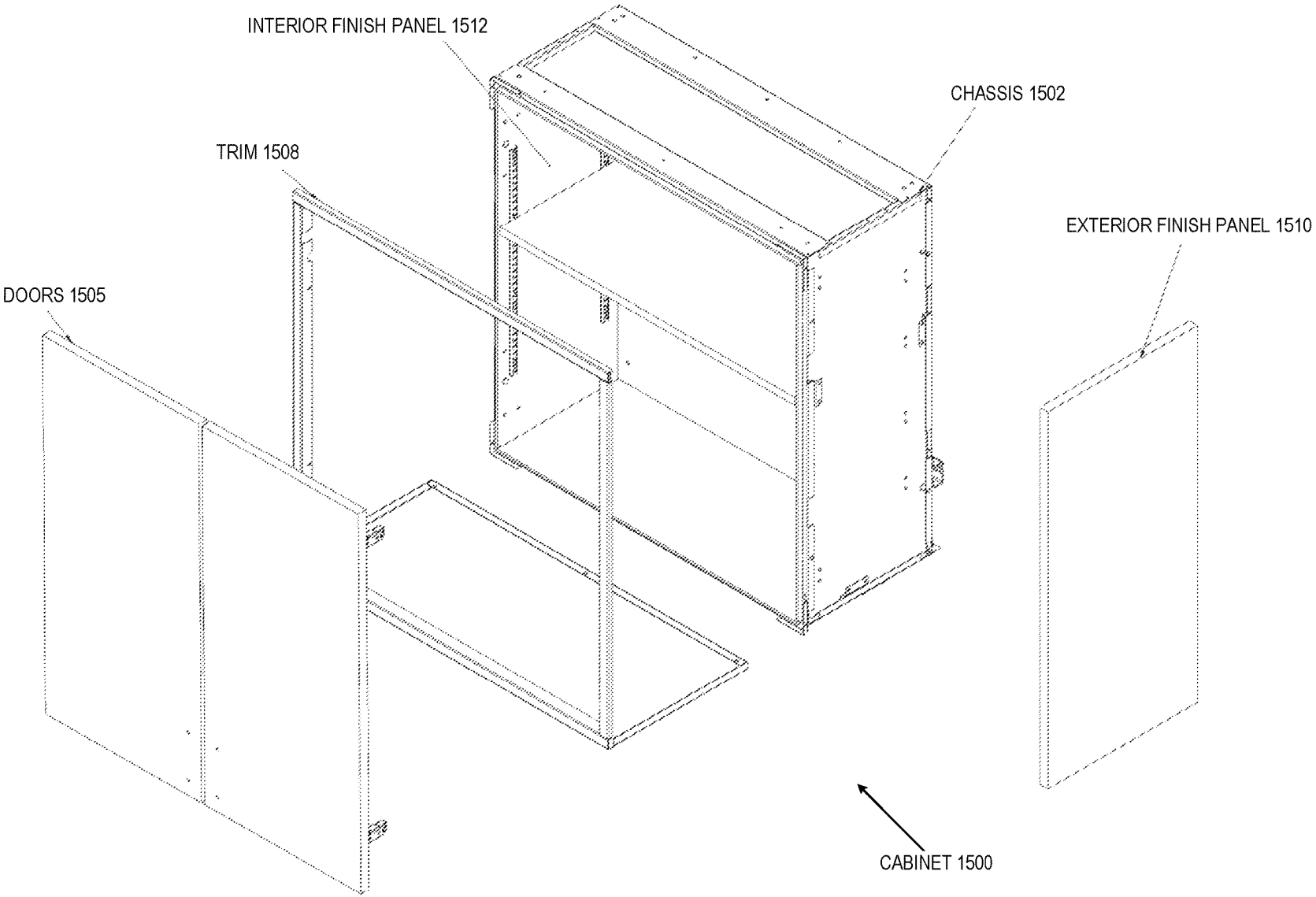

Turning to FIG. 15, an exploded view of the cabinet (1500) is shown. The cabinet (1500) may be an upper cabinet for an installation, e.g., the upper cabinet (1405) of FIG. 14. The cabinet (1500) includes the chassis (1502) and multiple finishing members. The finishing members include the doors (1505), the trim (1508), the exterior finish panel (1510), and the interior finish panel (1512).

Figure 16B:
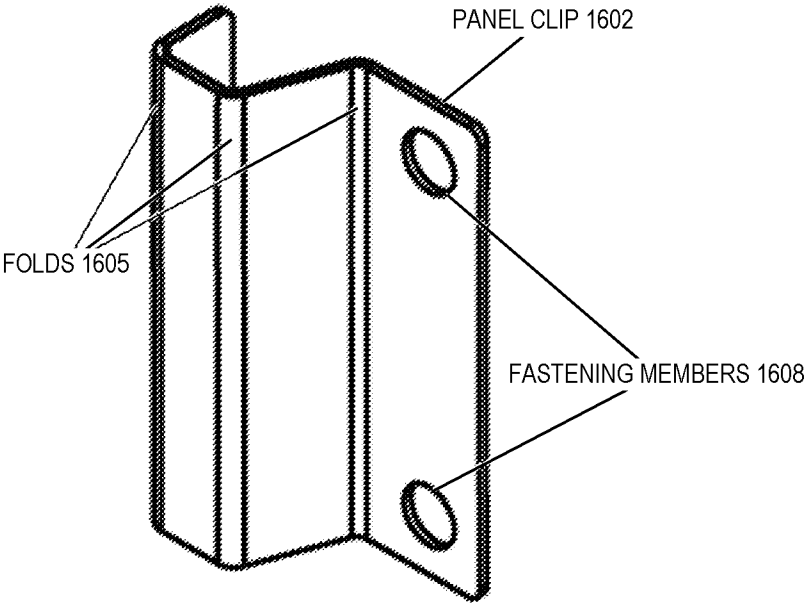
Figure 16A:
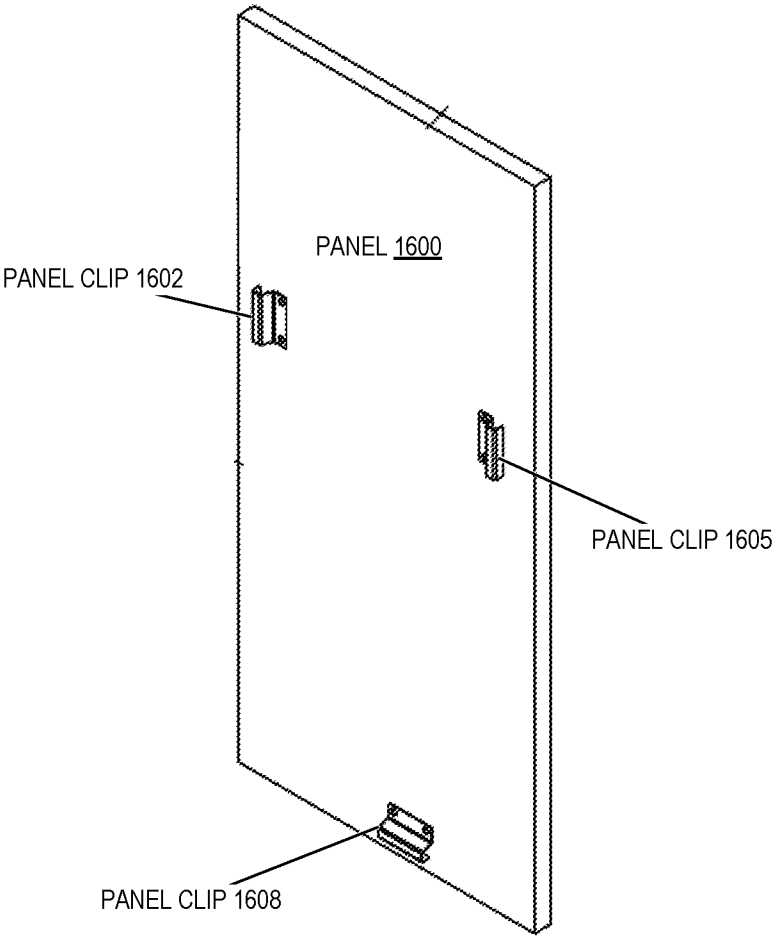

Turning to FIG. 16A, the panel (1600) is an exterior finish panel of a cabinet, e.g., the cabinet (1500) of FIG. 15. The panel (1600) includes the panel clips (1602), (1605), and (1608). The panel clips (1602), (1605), and (1608) secure the panel (1600) to a chassis.

Turning to FIG. 16B, the panel clip (1602) includes the folds (1605) to form a structural member to secure an exterior panel to a chassis. The panel clip (1602) includes the fasting members (1605) used to secure the panel clip (1602) to an exterior panel.

Figure 16C:
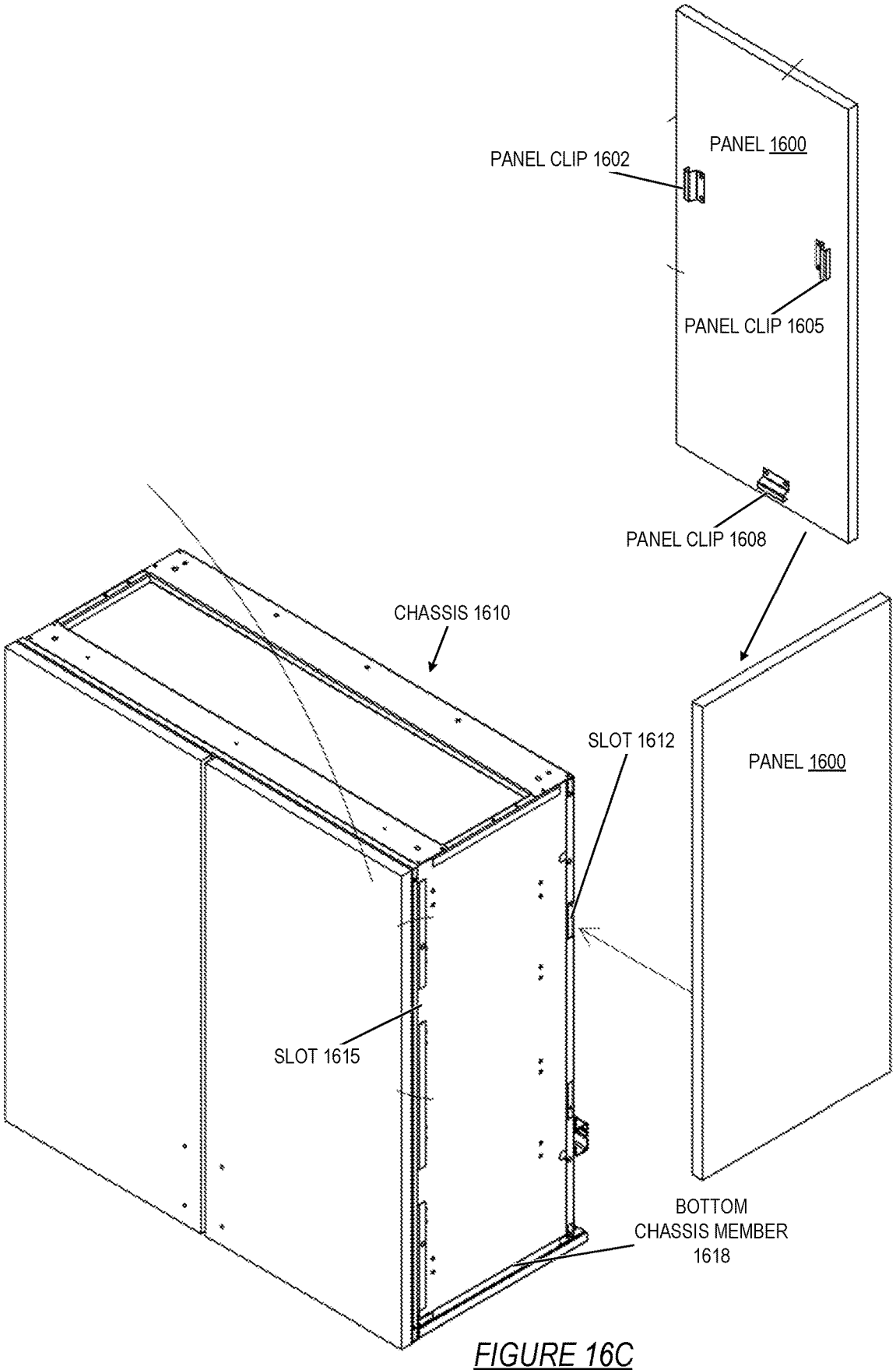

Turning to FIG. 16C, the panel (1600) is maneuvered to be fitted to the chassis (1610). The chassis (1610) includes the slot (1612) into which the panel clip (1602) is placed and includes the slot (1615) into which the folds (1605) is placed. After being placed on to the side of the chassis (1610) with the panel clips (1602) and (1605) in the slots (1612) and (1615, the panel (1600) is slid down for the panel clip (1608) to engage with the bottom chassis member (1618) of the chassis (1610). Engaging each of the panel clips (1602), (1605), and (1608) with the chassis (1610) secures the panel (1600) to form a cabinet.

Figure 17A:
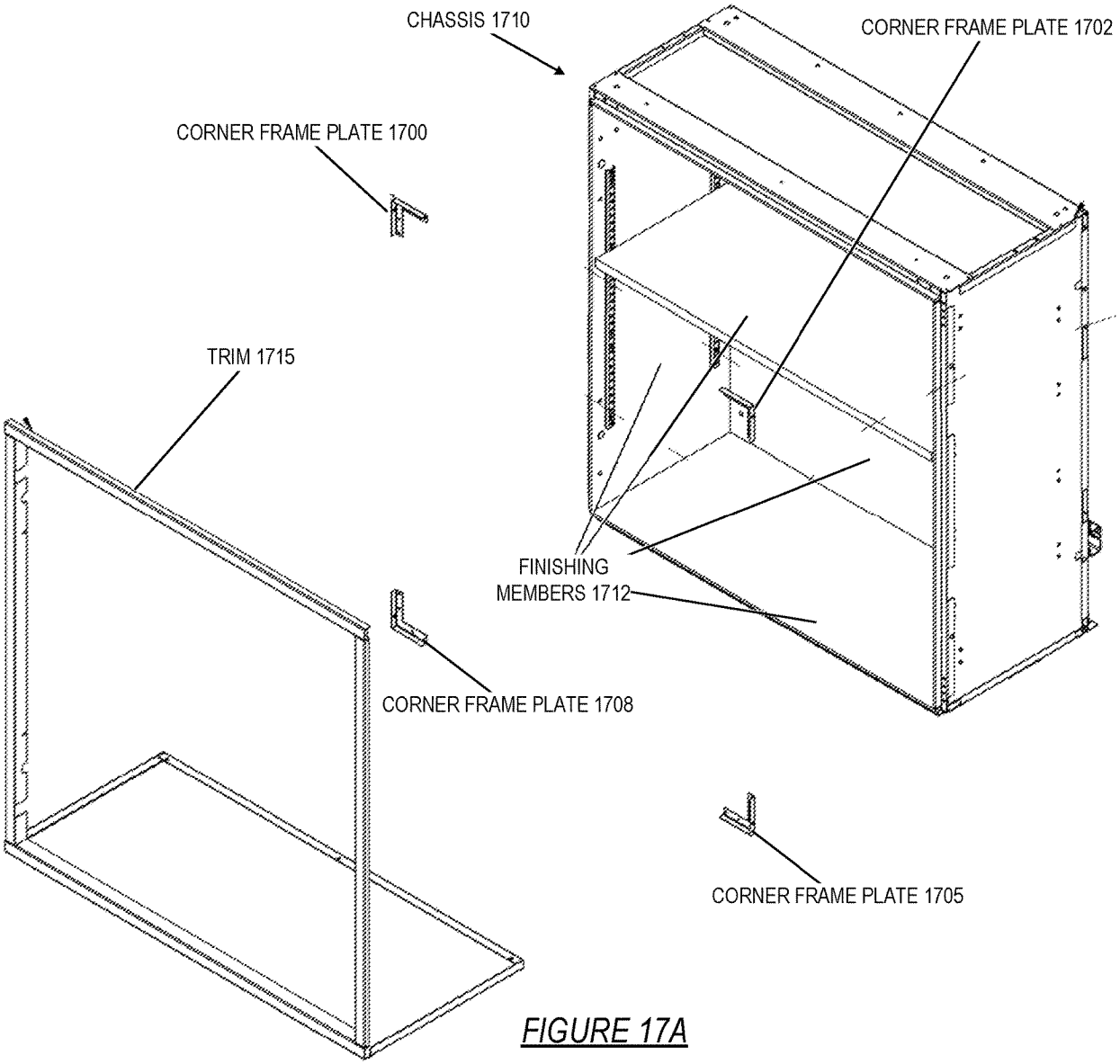

Turning to FIG. 17A, the corner frame plates (1700), (1702), (1705), and (1708) are chassis members installed to the chassis (1710) after installation of the interior finishing members (1712) to the chassis (1710). The corner frame plates (1700), (1702), (1705), and (1708) are used to secure the trim (1715) to the chassis (1710).

Figure 17B:
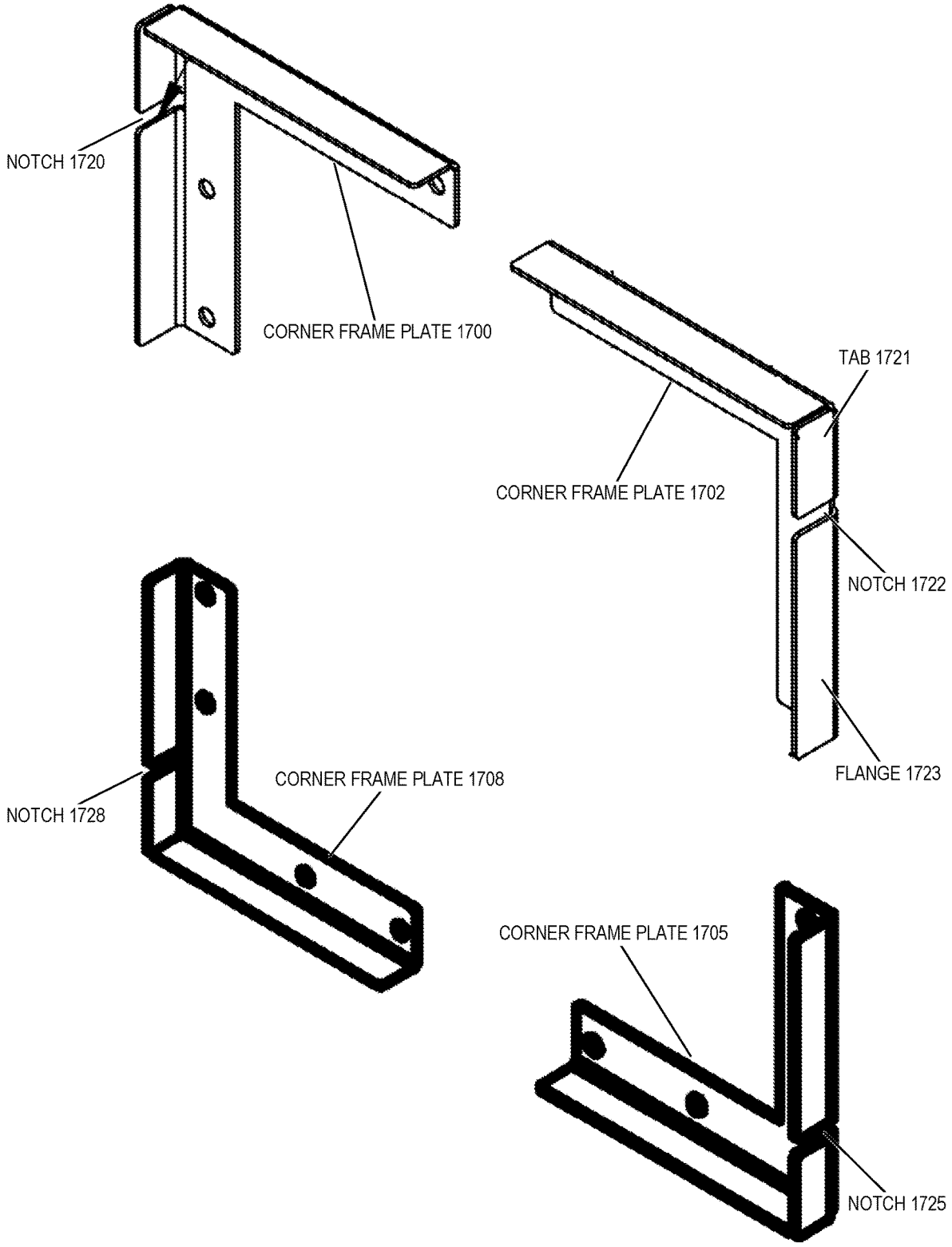

Turning to FIG. 17B, the corner frame plates (1700), (1702), (1705), and (1708) respectively include the notches (1720), (1722), (1725), and (1728). The notches (1720), (1722), (1725), and (1728) provide spacing for the trim (1715) of FIG. 17A to fit onto the chassis (1710) of FIG. 17A. The notch (1722) is made from the space between the tab (1721) and the flange (1723) of the corner frame plate (1702). In one embodiment, certain corner frame plates may be symmetrical. For example, the corner frame plates (1700) and (1705) may have the same structure and notch placement, which are different from the structure and notch placement of the corner frame plates (1702) and (1708).

Figure 17C:
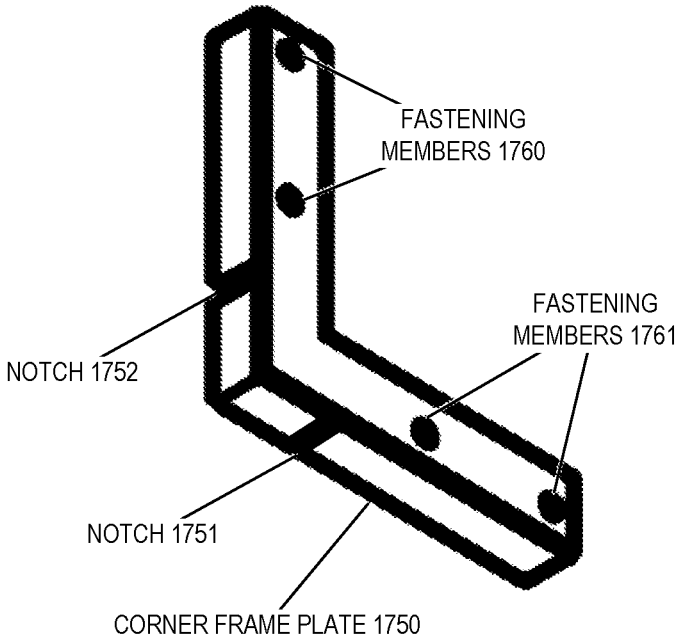

Turning to FIG. 17C, the corner frame plate (1750) is a fully symmetrical corner frame plate. The notches (1751) and (1752) are a same size and length from the edges of the corner frame plate (1750). The fastening members (1760) are symmetrical with the fastening members (1761). In one embodiment, the corner frame plate (1750) may be used in place of any one of the corner frame plates (1700), (1702), (1705), and (1708) of FIG. 17B.

Figure 17D:
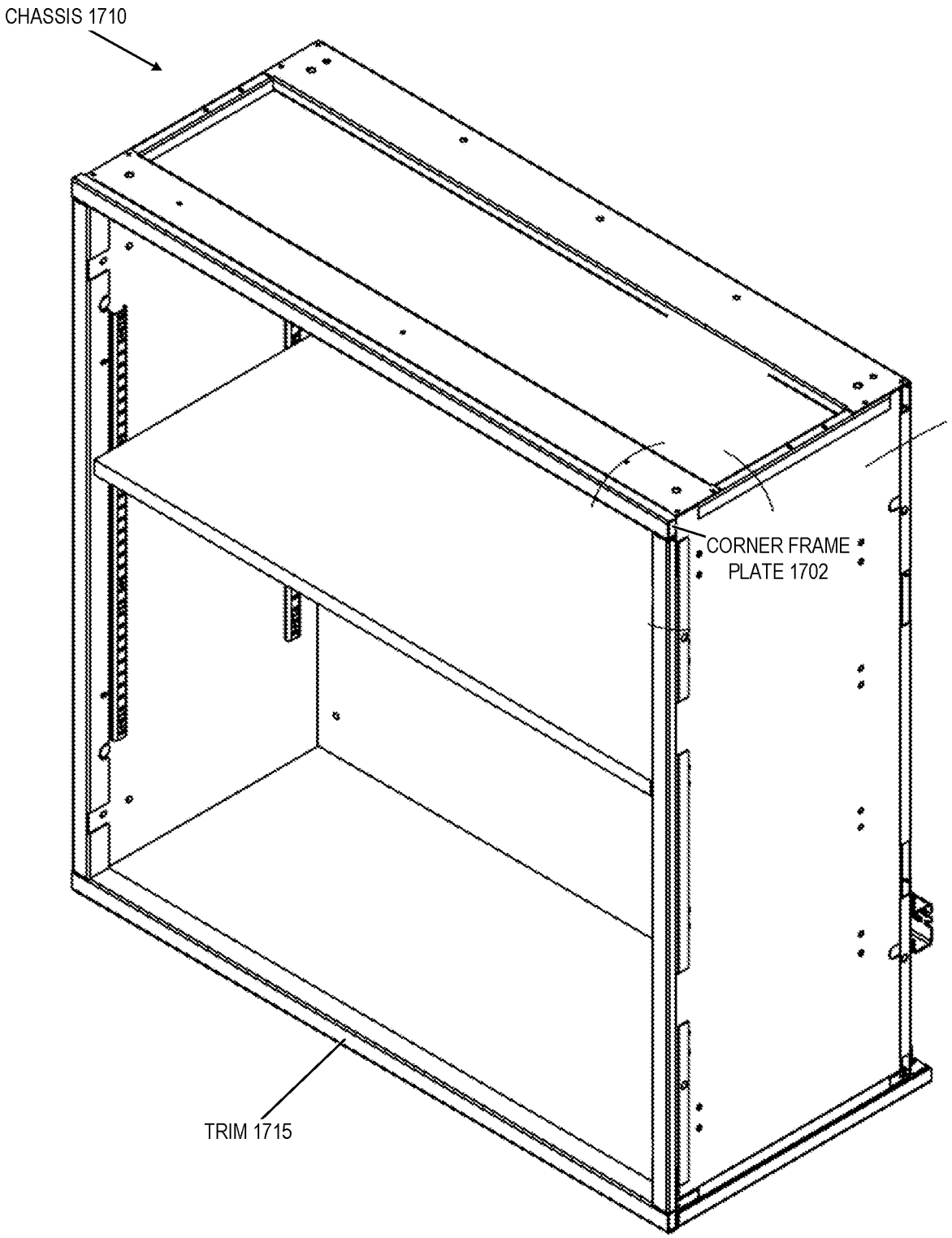

Turning to FIG. 17D, the trim (1715) is placed onto the chassis (1710). The trim (1715) fits to the chassis (1710) using the corner frame plates (1700), (1702), (1705), and (1708), which are occluded from view except for a portion of the corner frame plate (1702).

Figure 17E:
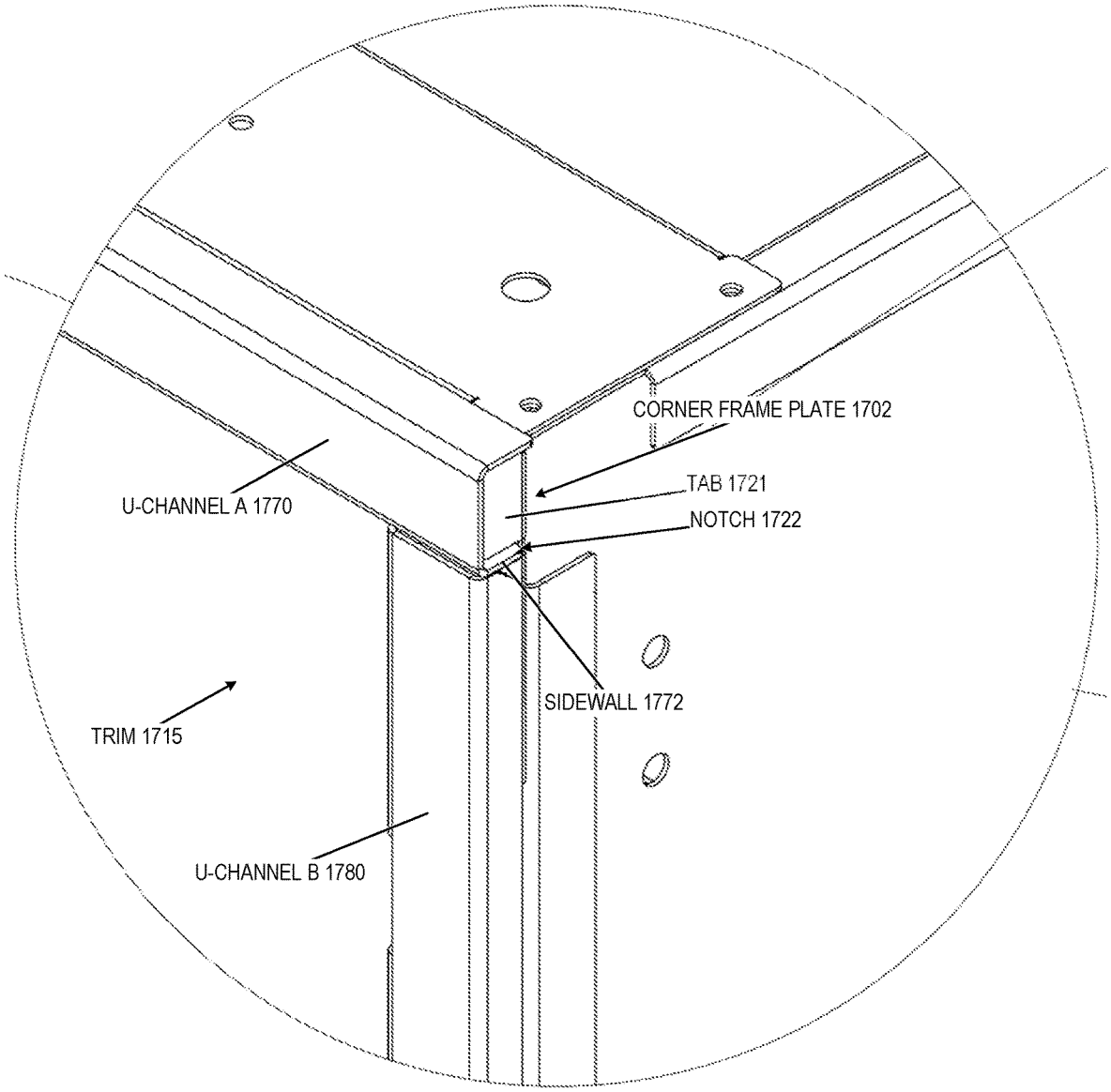

Turning to FIG. 17E, the u-channel A (1770) of the trim (1715) wraps around the tab (1721) of the corner frame plate (1702). The sidewall (1772) of the u-channel A (1770) fits into the notch (1722) of the corner frame plate (1702). The u-channel B (1780) of the trim (1715) wraps around and occludes the flange (1723) (see FIG. 17B) of the corner frame plate (1702).

As used herein, the term "connected to" contemplates multiple meanings. A connection may be direct or indirect (e.g., through another component or network). A connection may be wired or wireless. A connection may be temporary, permanent, or semi-permanent communication channel between two entities.

The various descriptions of the figures may be combined and may include or be included within the features described in the other figures of the application. The various elements, systems, components, and steps shown in the figures may be omitted, repeated, combined, and/or altered as shown from the figures. Accordingly, the scope of the present disclosure should not be considered limited to the specific arrangements shown in the figures.

In the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, unless expressly stated otherwise, the word "or" is an "inclusive or" and, as such includes "and." Further, items joined by an or may include any combination of the items with any number of each item unless expressly stated otherwise.

In the above description, numerous specific details are set forth in order to provide a more thorough understanding of the disclosure. However, it will be apparent to one of ordinary skill in the art that the technology may be practiced without these specific details. In other instances, well-known features have not been described in detail to avoid unnecessarily complicating the description. Further, other embodiments not explicitly described above can be devised which do not depart from the scope of the claims as disclosed herein. Accordingly, the scope should be limited only by the attached claims.

What is claimed is:

1. An apparatus forming a cabinet, the apparatus comprising:

a chassis that is metallic and forms a load bearing structure of the cabinet, wherein the chassis is formed of a plurality of chassis members;

a chassis member of the plurality of chassis members is assembled to the chassis using one or more fasteners of the cabinet;

a plurality of finishing members comprising an interior member assembled to an interior of the chassis and an exterior member assembled to an exterior of the chassis; and a mounting rail including a rail slot, wherein the mounting rail is structured to receive a spacer stick through the rail slot to align a plurality of mounting rails comprising the mounting rail, wherein the rail slot comprises a member thickness and a fastener thickness, and wherein the fastener thickness is greater than the member thickness.

2. The apparatus of claim 1, further comprising:

one or more corner frame plates configured to mount and align a trim member of the cabinet.

3. The apparatus of claim 1, further comprising:

one or more panel clips of a finishing member of the plurality of finishing members, wherein the one or more panel clips are configured to removably affix the finishing member to the chassis.

4. The apparatus of claim 1, further comprising:

a fastener configured to provide tension between the mounting rail and the chassis to secure the cabinet to the mounting rail.

5. The apparatus of claim 1, wherein:

the mounting rail includes a plurality of stud holes, and a stud hole of the plurality of stud holes is sized for multiple screws.

6. The apparatus of claim 1, wherein:

the plurality of finishing members comprises one or more of a countertop, a sink, and a backsplash; and a finishing member of the finishing members is secured to the chassis with a magnet.

7. The apparatus of claim 1, wherein:

the rail slot is structured to fit the spacer stick, wherein the spacer stick comprises a stick slot structured to insert to the rail slot so that a fastener inserted through the spacer stick makes solid contact with a body of the mounting rail between one or more holes of the mounting rail.

8. The apparatus of claim 1, the apparatus comprising:

a backsplash mounting tab comprising a fastener securing the backsplash mounting tab by pushing a proximate end of the backsplash mounting tab away from the mounting rail, wherein the proximate end is proximate to the fastener.

9. An apparatus forming a cabinet, the apparatus comprising:

a chassis that is metallic and forms a load bearing structure of the cabinet, wherein the chassis is formed of a plurality of chassis members;

a chassis member of the plurality of chassis members is assembled to the chassis using one or more fasteners of the cabinet;

a plurality of finishing members comprising an interior member assembled to an interior of the chassis and an exterior member assembled to an exterior of the chassis; and a mounting rail including a rail slot structured to fit a spacer stick, wherein the spacer stick comprises a stick slot structured to insert to the rail slot so that a fastener inserted through the spacer stick makes solid contact with a body of the mounting rail between one or more holes of the mounting rail.

10. The apparatus of claim 9, wherein:

the mounting rail is structured to receive the spacer stick through the rail slot to align a plurality of mounting rails comprising the mounting rail, the rail slot comprises a member thickness and a fastener thickness, and the fastener thickness is greater than the member thickness.

11. The apparatus of claim 9, further comprising:

one or more corner frame plates configured to mount and align a trim member of the cabinet.

12. The apparatus of claim 9, further comprising:

one or more panel clips of a finishing member of the plurality of finishing members, wherein the one or more panel clips are configured to removably affix the finishing member to the chassis.

13. The apparatus of claim 9, further comprising:

a backsplash mounting tab comprising a second fastener securing the backsplash mounting tab by pushing a proximate end of the backsplash mounting tab away from the mounting rail, wherein the proximate end is proximate to the second fastener.

14. The apparatus of claim 9, wherein:

the plurality of finishing members comprises one or more of a countertop, a sink, and a backsplash; and a finishing member of the finishing members is secured to the chassis with a magnet.

15. An apparatus forming a cabinet, the apparatus further comprising:

a chassis that is metallic and forms a load bearing structure of the cabinet, wherein the chassis is formed of a plurality of chassis members;

a chassis member of the plurality of chassis members is assembled to the chassis using one or more fasteners of the cabinet;

a plurality of finishing members comprising an interior member assembled to an interior of the chassis and an exterior member assembled to an exterior of the chassis; and a backsplash mounting tab comprising a fastener securing the backsplash mounting tab by pushing a proximate end of the backsplash mounting tab away from a mounting rail, wherein the proximate end is proximate to the fastener.

16. The apparatus of claim 15, further comprising:

the mounting rail including a rail slot, wherein the mounting rail is structured to receive a spacer stick through the rail slot to align a plurality of mounting rails comprising the mounting rail; and wherein the rail slot comprises a member thickness and a fastener thickness, and wherein the fastener thickness is greater than the member thickness.

17. The apparatus of claim 15, further comprising:

a rail slot of the mounting rail, the rail slot structured to fit a spacer stick, wherein the spacer stick comprises a stick slot structured to insert to the rail slot so that a second fastener inserted through the spacer stick makes solid contact with a body of the mounting rail between one or more holes of the mounting rail.

18. The apparatus of claim 15, further comprising:

one or more corner frame plates configured to mount and align a trim member of the cabinet.

19. The apparatus of claim 15, further comprising:

one or more panel clips of a finishing member of the plurality of finishing members, wherein the one or more panel clips are configured to removably affix the finishing member to the chassis.

20. The apparatus of claim 15, wherein:

the plurality of finishing members comprises one or more of a countertop, a sink, and the backsplash; and a finishing member of the finishing members is secured to the chassis with a magnet.

* * * * *